US010816256B2

(12) United States Patent
Knight et al.

(10) Patent No.: US 10,816,256 B2
(45) Date of Patent: Oct. 27, 2020

(54) THERMALLY INSULATED CONTAINER ASSEMBLY

(71) Applicant: LAMINAR MEDICA LIMITED, Tring Hertfordshire (GB)

(72) Inventors: Philip Knight, Tring Hertfordshire (GB); Scott Talbot, Tring Hertfordshire (GB); Geraint Thomas, Tring Hertfordshire (GB)

(73) Assignee: LAMINAR MEDICA LIMITED, Tring Hertfordshire (GB)

( * ) Notice: Subject to any disclaimer, the term of this patent is extended or adjusted under 35 U.S.C. 154(b) by 150 days.

(21) Appl. No.: 15/548,823

(22) PCT Filed: Jan. 29, 2016

(86) PCT No.: PCT/GB2016/050195
§ 371 (c)(1),
(2) Date: Aug. 4, 2017

(87) PCT Pub. No.: WO2016/124892
PCT Pub. Date: Aug. 11, 2016

(65) Prior Publication Data

US 2018/0017311 A1 Jan. 18, 2018

(30) Foreign Application Priority Data

Feb. 5, 2015 (GB) ..... 1501913.6
Feb. 5, 2015 (GB) ..... 1501914.4
(Continued)

(51) Int. Cl.
*F25D 3/08* (2006.01)
*B65D 81/38* (2006.01)

(52) U.S. Cl.
CPC ..... *F25D 3/08* (2013.01); *B65D 81/3816* (2013.01); *F25D 2201/126* (2013.01);
(Continued)

(58) Field of Classification Search
CPC .... F25D 3/08; F25D 201/126; F25D 2201/14; F25D 2303/082; F25D 2303/0822;
(Continued)

(56) References Cited

U.S. PATENT DOCUMENTS 4,923,077 A * 5/1990 Van Iperen ..... B65D 81/18 206/205
5,423,996 A * 6/1995 Salyer ..... A61F 7/03 165/104.12
(Continued)

FOREIGN PATENT DOCUMENTS

DE 10 2008 042907 A1 4/2010
DE 102008042907 A1 4/2010
(Continued)

OTHER PUBLICATIONS

International Search Report related to Application No. PCT/GB2016/050195 reported on Jul. 25, 2016.
(Continued)

*Primary Examiner* — Marc E Norman
*Assistant Examiner* — Schyler S Sanks
(74) *Attorney, Agent, or Firm* — Miller, Matthias & Hull LLP

(57) ABSTRACT

The present invention provides a thermally insulated container comprising an expanded foam layer, a further layer, internal of the expanded foam layer, formed of a plurality of cool packs or insulation panels, and a locking lid. The cool packs consist of a combination of cool packs with stepped edges and individual side wall cool packs side wall cool packs formed with a living hinge, wherein the cool packs consist of a protruding fill point on one edge and blanking protrusions on the remaining three edges, and the cool packs comprise recesses on the top and bottom edges to accommodate either the fill point or the blanking protrusion of each
(Continued)

adjacent cool pack. The insulation panels are pre-assembled on a sheet ready for insertion into the container. The expanded foam layer includes a number of individual pre-formed sections assembled to form a main body of the container, the main body consisting of a rectangular base and four wall sections, wherein inner faces of opposed pairs of wall sections are substantially parallel to each other. The locking lid comprises a main body formed from an expanded foam and a locking member formed from expanded foam, the main body being arranged to be received in and to close a mouth of the container and the locking member being arranged to rotate to lock the lid in place. The lid in accordance with the invention may provide a particularly efficient thermal barrier.

3 Claims, 14 Drawing Sheets

(30) Foreign Application Priority Data

| | | |
|---|---|---|
| Feb. 5, 2015 | (GB) | 1501917.7 |
| Feb. 5, 2015 | (GB) | 1501919.3 |
| Feb. 5, 2015 | (GB) | 1501921.9 |
| Feb. 5, 2015 | (GB) | 1501922.7 |

(52) U.S. Cl.
CPC .... *F25D 2201/14* (2013.01); *F25D 2303/082* (2013.01); *F25D 2303/0822* (2013.01); *F25D 2303/08222* (2013.01)

(58) Field of Classification Search
CPC ..... F25D 2303/08222; F25D 2303/083; F25D 2303/0831; F25D 2303/0832; F25D 2303/08221; B65D 81/3816; B65D 81/382
See application file for complete search history.

(56) References Cited

U.S. PATENT DOCUMENTS

| | | | | |
|---|---|---|---|---|
| 5,984,953 | A * | 11/1999 | Sabin | A61F 7/03 607/114 |
| 6,083,256 | A * | 7/2000 | Der Ovanesian | A61F 7/02 607/114 |
| 7,721,566 | B1 * | 5/2010 | Wilken | A01N 1/0273 62/371 |
| 2002/0088244 | A1 * | 7/2002 | Jennings | A47F 3/0404 62/371 |
| 2010/0263399 | A1 * | 10/2010 | Pollina | F25D 3/08 62/331 |
| 2014/0054297 | A1 * | 2/2014 | Patstone | F25D 3/08 220/592.01 |

FOREIGN PATENT DOCUMENTS

| | | | |
|---|---|---|---|
| EP | 2 374 443 | A1 | 10/2011 |
| EP | 2374443 | A1 | 10/2011 |
| EP | 2700891 | A2 | 2/2014 |
| GB | 2 286 385 | A | 8/1995 |
| WO | 2010132726 | A1 | 11/2010 |
| WO | 2015044668 | A1 | 4/2015 |
| WO | 2017060695 | A1 | 4/2017 |

OTHER PUBLICATIONS

European Search Report related to Application No. 17184856.7; completed on Jan. 24, 2018.

* cited by examiner

THERMALLY INSULATED CONTAINER ASSEMBLY

CROSS-REFERENCE TO RELATED APPLICATIONS

This Application is a 35 USC § 371 US National Stage filing of International Application No. PCT/GB2016/050195 filed on Jan. 29, 2016, and claims priority under the Paris Convention to Great Britain Patent Application Nos. 1501913.6, 1501917.7, 1501914.4, 1501922.7, 1501921.9 and 1501919.3, all filed on Feb. 5, 2015.

FIELD OF THE INVENTION

The present invention relates to thermally insulated containers and the components used in said containers, relating particularly, but not exclusively, to the cool packs, lid, insulation panels and outer assembly panels for use in thermally insulated containers. The invention has particular application for use in insulated shipping containers, known as passive insulated shippers, which are used to transport products at stabilised temperatures.

BACKGROUND OF THE INVENTION

It is important that some products, for example certain types of pharmaceuticals or biotech products, are maintained within a specified temperature range, typically 2° C. to 8° C., to prevent the product from being damaged, or its shelf-life being reduced relative to the shelf-life stated on the product. The product may be a very high value medicine or the like, which will be worthless if its temperature is not correctly controlled. This may be problematic during shipment and use of an insulated shipper will often be necessary to make shipment practicable.

One type of insulated shipper is known as an active shipper. These generally comprise a thermally insulated container having a cooling device and/or heating element for controlling the interior temperature of the shipper and thus the product. Energy is normally provided, from an external electrical supply, or an internal battery. The present invention may have application to such an active shipper but is particularly applicable for use in what is generally termed a passive shipper.

Passive insulated shippers comprise an insulated container comprising an insulated outer casing which is lined with, or houses, a number of cool blocks, cool trays, gel packs, cool bricks or similar, which for the purposes of the present specification are collectively referred to as cool packs. These may be cooled until a phase change occurs in the refrigerant in the cool packs from a liquid to a solid, so that the subsequent phase change back from a solid to a liquid acts to maintain the contents of the container at a constant temperature. Examples of materials which change state from a solid to a liquid to produce a cooling effect, are paraffin wax and water-based solutions.

Although reference above and below is made only to cool packs and the requirement to maintain a product at or below a certain temperature, those packs may also be used to maintain a product above a certain temperature, for example to stop a product freezing if it is being shipped in a cold climate. Thus, although for the purposes of this specification they will be referred to only as cool packs and only the case of keeping the product cool will be discussed, it will be appreciated that the invention is equally applicable to applications where it is desired to maintain the product above a desired temperature and the description and claims are to be interpreted so as not to preclude such an application.

Passive insulated shippers may comprise a container having three layers, an outer insulating layer, typically formed from expanded foam, an inner layer of cool packs and an intervening layer between the outer and inner layers made up of a number of vacuum insulation panels to provide enhanced insulation. The container may further comprise an outer casing to provide protection for the outer insulating layer during transportation and/or an inner lining.

A passive shipper of the type described above therefore has a large number of components which have to be initially assembled. Then, each time the container is used, at least the cool packs will normally have be removed, cooled, and then correctly reassembled in the container, possibly by staff not familiar with that particular container type.

Known containers for use as passive shippers usually have a number of cool packs, each in the form of a regular rectangular block, with six or more cool packs dispersed around a central space for the product that is to be shipped. Several, if not all of these cool packs may be identical to each other.

To simplify assembly of the cool packs, each shipper would ideally have six identical square cool packs arranged to form a cube, for in this manner any cool pack could be selected for any of the six sides and each could be correctly positioned in any of eight orientations. However, cool packs, particularly cool blocks, normally have a fill point by which the cool pack is filled with a refrigerant. Due to the construction techniques of cool packs and particularly of cool blocks, the fill point is normally formed on one edge of the cool block. This prevent adjacent edges of cool packs being closely abutted and thus would make it difficult to restrict convection currents between adjacent cool packs, particularly if the edges of the cool packs should be specifically profiled to reduce thermal convection between adjacent edges.

It is desirable that as many of these components as possible are standardised, to reduce the number of types of components to assist in selection. It is also desirable that each component can be positioned with one of several orientations to assist in locating them correctly and that the components need no additional means to hold them in place, other than by being positioned in an outer structure of the container.

The present inventors have identified that in certain applications, for example in a thermally insulated shipper of the type previously described, it can be advantageous for a cool pack arrangement to form a substantially continuous layer in a container, for example by forming five sides of a cube or similar shape, or six sides where one cool pack also forms a lid. They have further identified that with such an arrangement, if the cool packs are held closely together, so that their edges abut, the cool packs themselves may not only provide a thermal mass, but that they may also improve the thermal efficiency of the container, by forming a physical barrier to convection currents that may otherwise occur within the container. However, it is also desirable that there be a minimum number of cool pack types in an insulated shipper, for the cool packs have to be removed to be cooled prior to a product being shipped in an insulated shipper and therefore the cool packs have to subsequently be quickly and correctly assembled each time the shipper is used and this may present a considerable burden if a single consignment of a product requires a large number of shippers to be charged and dispatched at the same time.

SUMMARY OF THE INVENTION

According to a first aspect of the present invention there is provided a cool pack comprising at least two rigid compartments each containing a coolant, the two compartments being joined by a living hinge.

The first aspect of the present invention, in providing a cool pack comprising at least two rigid compartments, which two compartments are joined by a living hinge which may be formed integrally with the two compartments, enables the cool pack to both lie flat for storage or whist being cooled in a refrigerator or the like and to be folded, possibly at right angles to each other, for example to permit the compartments to form at least two walls of a cool pack layer in a container. This may significantly reduce the number of cool packs required for use in a container and thus simplify assembly of cool packs in a container. It also permits the two compartments when folded, for example at right angles to each other, to be free standing, avoiding the problems of having to assemble four separate loose cool packs to form four walls of a compartment, before they are locked in place by inserting insulation panels or a product.

The cool pack may be formed by being blow moulded and/or may be formed of a high density polyethylene or polypropylene. A cool pack formed by blow moulding and/or of high density polyethylene may provide two rigid or semi rigid compartments which when filled with a coolant do not deform to any significant extent, but which permit the two compartments to be formed integrally with the living hinge and permit the two compartments to be folded together, advantageously to 90° so that they may form two walls of a cool pack layer within a rectangular container.

Each compartment may have substantially parallel planar front and rear surfaces, wherein adjacent edges of the two compartments, which are joined by the living hinge and which each define a side edge of a respective compartment, are chamfered at substantially 45 degrees, so that when the two compartments are arranged at 90 degrees to each other the two adjacent side edges of the two compartments abut each other. The chamfered edges may be arranged to prevent the two compartments from being folded through more than 90° and may slightly bias the compartments apart from the 90° folded state. This may assists in inserting the cool pack to form two walls within a container, as the cool pack will tend to jamb itself in to a corner so that the two compartments extend along the two sides of the container.

Preferably, the side edges of each compartment opposite to the living hinge are also chamfered at 45°, so that each may abut a corresponding side edge of a similar cool pack. Thus, two cool packs in accordance with the first aspect of the present invention may line all four walls of a container, with the four compartments all being effectively locked together.

Advantageously, each compartment has substantially planar top and bottom edges, perpendicular to the front and back faces of the respective compartment. This may assist in standing the walls upright where the cool pack is to form two or more walls of a cool pack layer.

A cool pack may comprise four compartments joined by three living hinges, wherein the four compartments may fold together to form a square or rectangle. Thus a single cool pack may define all four walls of a cool pack layer in a container.

In one embodiment, the width of each compartment, from the living hinge on one side to the side opposite the living hinge, is the same. In this way the cool pack may be shaped so that it is immaterial which way up it is located in a container and the dimensions of each compartment may be substantially identical.

According to a second aspect of the present invention there is provided a cool pack arrangement comprising a first substantially planar cool pack having at least one edge with a first profile and a second cool pack having at least one edge with a second profile, wherein the first and second profiles are such that when the first and second edges abut they provide a stepped path for any convection between the two edges.

By a "stepped path", as used in the context of the present specification including the claims, it is meant that the path through which air must flow to get through a gap between adjacent cool packs includes an angle of approximately 90°. Such a stepped flow path significantly disrupts and reduces the flow of air especially inside a container where the flow of air is induced only by convection.

Providing a stepped profile between two edges also permits a minimum separation to be maintained between adjacent cool packs even though one of the cool packs may be imperfectly aligned with the other cool pack. For example, in the case where a first cool pack has a first profile with a step in it and the second cool pack has a second profile with a right angled edge, if the right angled edge of the second cool pack is arranged to sit in the step of the first cool pack, the second cool pack may move in a first direction parallel to the riser of the step, without increasing any separation between the riser of the step of the first cool pack and the edge of the second cool pack. Alternatively, if it moves in second direction parallel to the tread portion of the step of the first cool pack, then again any separation between the edge of the second cool pack and the tread portion of the step of the first cool pack will remain constant.

The stepped flow path may comprise a single step or it may comprise multiple steps, multiple steps further impeding the passage of convection.

In a particular advantageous embodiment of the second aspect of the present invention, the edge of the first cool pack has a first profile in the form of a step with a tread portion in the plane of the first cool pack and a riser portion perpendicular to the plane of the first cool pack and wherein the second cool pack has an edge with a second profile with two surfaces at right angles to each other to permit the said two surfaces to each lie parallel to and abut a respective one of the tread portion and riser portion of the edge of the first cool pack. This permits the second cool pack to stand on the tread portion of the edge of the first cool pack so that the second cool pack extends substantially perpendicular to the plane of the first cool pack.

Preferably, where the second cool pack stands on the tread portion of the edge of the first cool pack, so that the second cool pack extends substantially perpendicular to the plane of the first cool pack, the riser portion of the edge of the first cool pack acts to at least partially restrain the second cool pack from leaning inwards over the first cool pack. In this manner, one of the cool packs may form a base portion and the other a wall portion with the base portion assisting to maintain the wall portion upright until the cool pack arrangement is fully assembled.

Preferably, the edge of the second cool pack has a square profile which will assist the cool pack stand on that edge during assembly of the cool pack arrangement as well as minimising the flow of air between the assembled edges of the first and second cool packs.

In one advantageous embodiment, the cool pack arrangement comprises a first cool pack forming a base portion, the first cool pack having a plurality of straight edges each having a stepped profile, and one or more second cool packs forming side wall portions, each side wall portion comprising one substantially planar cool pack or one substantially planar cool pack compartment, the cool pack compartment joined to another cool pack compartment by a living hinge, as per the first aspect of the present invention. Each second cool pack or cool pack compartment has at least one edge with a second profile corresponding to the stepped profile of the first cool pack. The plurality of second cool packs or cool pack compartments are each arranged to stand upright on a respective edge of the first cool pack, thus forming walls and a base. Where the cool packs are cooled, the stepped profile of the base portion will resist downward convection from the space defined by the cool packs and conduction through contact with the main body.

Preferably, all the second cool packs are identical to assist in assembly.

Advantageously, the first cool pack has four edges in the shape of a square or rectangle, the cool pack arrangement comprising at least four second cool packs or cool pack compartments arranged to stand on tread portions of the four edges of the first cool pack and abut each other to form a structure where the first cool pack forms a base portion with the four second cool packs or cool pack compartments upstanding from the edges thereof to form four wall portions.

Preferably the side edges of each of the second cool packs are chamfered at substantially 45° so that each may abut a side edge of an adjacent cool pack, for in this manner the second cool packs may be interchangeable and easily assembled.

The cool pack arrangement may comprise two identical first cool packs, where one of the first cool packs forms the base portion and the other forms a lid portion when inverted relative to the cool pack of the base portion, so that two first cool packs and four second cool packs or cool pack compartments may effectively form a complete six sided cool pack layer around a space for a product.

Advantageously, a top edge of each of the second cool packs, when assembled, has a profile substantially identical to the profile of its bottom edge, so that when each second cool pack abuts a respective edge of the cool pack forming the lid, the profiles of the respective adjoining edges are such that they provide a stepped path for any convection between the top edge of the second cool pack and the respective edge of the first cool pack forming the lid, thus convection is resisted along both the upper and lower edges of the cool pack arrangement. Preferably, the cool packs are substantially rigid to maintain their shape and therefore effectively seal with each other. They may be blow moulded and/or formed from high density polyethylene.

According to a third aspect of the present invention there is provided a cool pack arrangement comprising a base cool pack having a plurality of edges and at least one side wall cool pack or cool pack compartment arranged to be located on or against a respective edge of the base cool pack, wherein the base cool pack has a fill point protruding from one edge and at least one blanking protrusion protruding from at least one other edge in a position along that edge corresponding to the position at which the fill point protrudes from its edge, wherein each side wall cool pack or cool pack compartment has a recess in a first edge which, when the side wall cool pack or cool pack compartment is located on or against the base cool pack, accommodates either the fill point of the base cool pack or a blanking protrusion, depending upon which edge of the base cool pack the side wall cool pack or cool pack compartment is located on or against, and wherein each side wall cool pack or cool pack compartment may be substantially planar.

In the cool pack arrangement of the third aspect of the present invention the fill point protruding from one edge of the base cool pack is accommodated in a recess in a first edge of a side wall cool pack or cool pack compartment. To avoid the requirement to provide a specific additional type of cool pack for this, the present aspect provides for multiple side wall cool packs or cool pack compartments (normally four) to each have a recess, permitting the side wall cool packs or cool pack compartments to be substantially identical. The base cool pack having at least one blanking protrusion protruding from at least one other edge, then acts to reduce convection losses that may occur through an otherwise unobstructed recess in the or each of the other side wall cool packs or cool pack compartments which is not positioned on the edge of the base cool pack with the fill point. Thus, the invention permits a plurality of substantially identical side wall cool packs or cool pack compartments to be employed whilst not significantly increasing convection currents.

Preferably, each side wall cool pack or cool pack compartment has a further recess on a second edge opposite the first edge so that each side wall cool pack or cool pack compartment can be located on or against an edge of the base cool pack in a first orientation or in a second orientation inverted relative to the first, so that one of the fill point or blanking protrusions extending from the base cool pack edge may be accommodated in either one of the two recesses on the side wall cool pack, depending on the orientation of that cool pack. The provision of recesses on opposite ends of the side wall cool pack or cool pack compartment means that if the side wall cool pack or cool pack compartment is rectangular it may be correctly positioned in more than one orientation.

Preferably, the cool pack arrangement further comprises a top cool pack identical to the base cool pack wherein, when the cool packs are assembled, the recesses in the opposite edges of each side wall cool pack or cool pack compartment accommodate both a fill point or blanking protrusion of the base cool pack and a fill point or blanking protrusion of the top cool pack. If, the base cool pack is square and the arrangement comprises four side wall cool packs or cool pack compartments, one on each edge of the base cool pack, which side wall cool packs or cool pack compartments together with the base cool pack form five sides of the cube, the four side wall cool packs or cool pack compartments may be substantially identical. Thus a six sided cool pack layer could be formed from only two cool pack types, namely a base/top cool pack type and a side wall cool pack type.

Each edge of the base cool pack may be in the form of a step, wherein each side wall cool pack or cool pack compartment is arranged to sit on a tread portion of the step with an inner face of the side wall cool pack or cool pack compartment resting against a riser portion of the step, from which riser portions the fill point or blanking protrusion protrudes. The step may act to restrict convection currents by not only providing a stepped path, where any convection has to pass through a right angled bend, but by also ensuring any gap between the edge of the base cool pack and the edge of the side wall cool pack or cool pack compartment is a minimised, even if the two cool packs should not be properly aligned. This is because where the side wall cool pack or cool pack compartment has a corner edge with two surfaces at right angles, which respectively abut the tread portion and the riser portion of the step, then any misalignment of that side wall cool pack or cool pack compartment relative to the base cool pack may result in either the tread portion or the riser portion of the cool pack still remaining in contact with a respective face of the side wall cool pack or cool pack compartment and thus restricts convection and thus convection between the two cool packs.

Preferably, the fill point and blanking protrusions are each located midway along the respective edge of the base cool pack, with each recess of the side wall cool packs or cool pack compartments located midway along the respective edge of the side wall cool packs or cool pack compartments. In this manner, the side wall cool packs or cool pack compartments may be inverted.

Advantageously, each side wall cool pack or cool pack compartment has an extended recess on one edge and a fill point which protrudes into said extended recess, the dimensions of the extended recess and location of the fill point being arranged such that the fill point is offset in the recess from the position in which the fill point or blanking protrusion of the base cool pack is accommodated. In this manner, the fill point of each side wall cool pack or cool pack compartment is accommodated within the overall outer profile of the side wall cool pack or cool pack compartment and thus does not interfere with the positioning of the side wall cool pack or cool pack compartment relative to the base cool pack.

In one advantageous embodiment, the cool pack arrangement comprises a square base cool pack and substantially identical top cool pack and four side wall cool packs or cool pack compartments each with a recess on a top edge and a bottom edge to accommodate a fill point or blanking protrusion of the base cool pack and top cool pack, each side wall cool pack or cool pack compartment having side edges chamfered at approximately 45° so that adjacent side edges may abut at the corners.

According to a fourth aspect of the present invention there is provided a lid for a thermally insulated container, the lid comprising a main body formed from expanded foam and a locking member formed from expanded foam, the main body being arranged to be received in and to close a mouth of the container and the locking member being arranged to be rotated to lock the lid in place.

A lid in accordance with the present invention may provide an efficient thermal barrier, for all the components are formed of expanded foam. Additionally, provision of a locking member means it is possible to secure the lid in a correct position on a container without the requirement to secure the lid by other means such as tape, the use of which often reduces the life expectancy of an insulated container, as the removal of the tape may result in damage of the container. Additionally, both the application and removal of tape can be relatively time consuming.

Advantageously, the main body of the lid is substantially planar and the locking member comprises at least one latch rotatably engaged in the main body of the lid and arranged to rotate about an axis substantially perpendicular to the plane of the main body, wherein in a first unlocked position the latch is housed within the main body and wherein, in a locked position, the latch extends out of the main body to engage with a wall of the container. In this manner, in the unlocked state, the latch is housed within the main body and therefore protected from accidental damage when the lid is removed from the container.

Advantageously, the at least one latch is formed integrally with a pin about which the locking member rotates and the main body of the lid forms a mouth through which the at least one latch extends when in the locked position.

Preferably, the main body of the lid is rectangular and the locking member comprises at least two latches which, when the locking member is a locked position, respectively extend out of the main body midway along two opposite sides of the main body. In this manner, a single locking member can comprise two latches which secure the lid at either side. More preferably the main body may be square and the locking member may have four latches which, when the locking is in a locked position, respectively extend out of the main body midway along each of the four sides securing the lid at each of its four sides.

Preferably, the main body of the lid comprises a top layer and a bottom layer with the locking member sandwiched between the two layers of the main body which may glued, adhered or welded together with the locking member rotatably sandwiched therebetween. Such an arrangement permits the lid to be formed entirely of an expanded foam such as expanded polypropylene.

According to a fifth aspect of the present invention there is provided an insulation panel assembly comprising at least two insulation panels for a container and a sheet on which the panels are pre-assembled ready for insertion into the container, wherein the at least two panels are substantially planar, each having an inner face arranged to in use face inwards towards contents of the container, an outer face arranged to in use face outwards away from the contents of the container, a top edge, a bottom edge and two opposed side edges, wherein the sheet is cut, stamped or formed so that the sheet wraps over at least the top or bottom edges of the insulation panels and has covering sections which respectively cover each inner face of the at least two panels, the sheet also having at least one section in the form of a continuous strip which runs along the outer faces of the at least two panels, wherein the sheet permits the at least two panels to be folded from a flat linear configuration to a configuration where adjacent panels are folded inwardly toward each other until they are substantially at right angles to each other, with those sections of the sheet covering the inner faces of the panels remaining substantially flat against those inner faces and with the strip section of the sheet on the outer faces constraining the panels, causing adjacent side edges of the panels to abut or causing a side edge of one panel to abut the edge of the inner face of an adjacent panel.

Common applications for insulation panels, such as for use in insulated containers and particularly for use in passive insulated shippers of the type described above, normally require a plurality of insulation panels to be employed to either line or form the four walls of the container, with additional insulation panels sometimes lining the base or roof (which may be a0020lid) of such a container. Thus, a container may typically have between four and six insulation panels and may also comprise, for example in the case of a passive shipper, between four and six cools packs, which are normally cooled remote from the container and thus have to be inserted in the container immediately prior to loading the container with a product for transportation.

An insulation panel assembly in accordance with the fifth aspect of the present invention permits a number of insulation panels to be simultaneously positioned within a container, such as an insulated shipper, permitting the panels to both lie flat prior to assembly in the container and then to be quickly and correctly positioned in the container. The sheet of the assembly may both provide a covering for the inner faces of the panels which, in the case of an application such as a passive shipper, will protect the panels from the cool packs, when these are inserted in to the container, whilst also providing a strip section extending around the panels, ensuring the panels are correctly positioned and that adjacent panels tightly abut each other (to avoid thermal losses through any gap between them), without the need for the panels to be taped together.

The assembly may comprise four insulation panels assembled on the sheet wherein, the sheet with the panels thereon may be folded so that the assembly forms four inner walls for insertion into a container. In this manner, a user only needs to a handle a single insulation panel assembly, which may be stored as a flat linear array of panels, permitting a number of assemblies to be stacked to conserve space. This single assembly can then simply be folded into a square shape to define four walls, prior to the assembly being placed in the container, the sheet then lining all four walls of the container, with the strip section extending completely around the four walls to lock them together.

Advantageously, the sheet may be folded over both the top and bottom edges of each panel to form two continuous strips which run along the outer faces of the insulation panels, at or towards both the top and bottom edges respectively. This may ensure that the panels are correctly positioned along both their top and bottom edges, ensuring there are no gaps between adjacent panels.

Preferably, each covering section of the sheet has a main portion arranged to cover the inner face of a respective insulation panel and an extension portion joined at one edge to the main portion, which extension portion extends around one of the side edges of the insulation panel.

If a side edge of each insulation panel abuts an adjacent edge portion of an inner face of an adjacent insulation panel and sandwiches the extension portion of the covering section of the adjacent insulation panel between the two insulation panels, then when the adjacent insulation panels are folded towards each other for insertion into a container, the extension portion, being sandwiched between those adjacent panels and abutting the edge portion of the inner face of adjacent insulation panel, also covered by one of the covering sections of the sheet, will avoid any gaps in the covering layer at a corner between two adjacent panels. In addition, the main portion of each covering section and associated extension portion will lie at right angles to each other, which right angle running down the side edge of the panel will act to maintain that edge of the main portion of the covering section straight and thus prevent the main portion of the covering section from buckling, keeping it flat against the inner face if the insulation panel. The sheet and covering section may be moulded or heat treated such that the main portion and extension portion inherently lie at right angles to each other.

Preferably, each covering section has only one extension portion that extends over only one side edge of the associated insulation panel. The "free" side edge of the main portion of the covering section will be held by being sandwiched between the insulation panel it is covering and a side edge of an adjacent insulation panel, which will act to keep that edge of the covering section flush against the insulation panel. The omission of an extension portion along one side edge permits the covering section to freely extend sideways, helping to prevent buckling of that covering section.

Preferably, the sheet is formed of a semi-rigid plastics material. This may both have sufficient rigidity to maintain the insulation panels in it without the need to weld, bond or otherwise adhere them in place, but it may also provide a lining for any container in which the assembly is used, which lining may be sufficiently strong to protect the insulation panels.

The sheet may be formed of polyvinylchloride.

In a preferred embodiment there is provided a thermally insulated container comprising an insulation panel assembly as described above. The container may comprise four insulated outer walls and a base formed from expanded foam, into which the insulated panel assembly is arranged to be inserted, the expanded foam providing both thermal insulation and protection from external objects for both the product to be shipped and the insulation panels.

Preferably the container further comprises a plurality of cool packs, preferably in an arrangement as previously described, and arranged to be received inside the insulation panel assembly.

According to a sixth aspect of the invention there is provided a thermally insulated container comprising an expanded foam layer and a further layer, internal of the expanded foam layer, formed of a plurality of cool packs or insulation panels, wherein the expanded foam layer includes a number of individual preformed sections assembled to form a main body of the container, the main body consisting of a rectangular base and four wall sections, wherein inner faces of opposed pairs of wall sections are substantially parallel to each other.

A container in accordance with the sixth aspect of the present invention may have opposed pairs of expanded foam wall sections with inner faces which are substantially parallel to each other, because the expanded foam layer is formed of a number of individual preformed sections. This is to be contrasted with conventional containers formed of expanded foam, which are normally moulded as a single piece (ignoring the lid) requiring that the internal walls be inwardly tapered in order to permit the container to be released from the mould.

The invention permits uniform square or rectangular cool packs and/or insulation panels to be located in the container, internally of the expanded foam layer and for these to be held firmly in place by the expanded foam layer, without the requirement for any additional fixings or padding. This is particularly advantageous where the container has a layer of cool packs which need to be removed to be cooled prior to a product being placed in the container for transportation, for the number of cool pack and/or insulation panel types may be kept to a minimum and these being square or rectangular may permit them each to be placed in the container in any of two or more orientations, significantly simplifying the assembly procedure.

Advantageously, the expanded foam layer includes an individual base section and four individual wall sections, for each of these may then be substantially planar and stacked together assisting in handling prior to assembly of the container.

Preferably, a first side edge of one wall section has a first set of engagement means and an adjacent side edge of an adjacent wall section has a second set of engagement means arranged to cooperate with the first set of engagement means, to hold the two wall sections together along their adjacent side edges. This permits the four wall sections to be attached together to form the rectangular side wall sections of the container, which can then be used to hold the other components such as inner cool packs and/or insulation panels together.

Preferably, the first and second sets of engagement means are arranged such that in order to assemble two adjacent wall sections together one wall section is placed approximately in the desired position relative to the other, but slightly inside of its final position and then pushed outwards to its final position to engage the two sets of engagement means. This permits the wall sections to be assembled without the use of tools.

In one embodiment, all four sections may be identical whereby a first side of each section will have a first set of engagement means with the other side having a second set of engagement means with the first and second sets of engagement means of adjacent panels arranged to cooperate with each other, thus minimising the number of component parts of the container.

Alternatively, the container may comprise a first pair of opposed wall sections which each have a first set of engagement means and a second pair of opposed wall sections which each have a second set of engagement means arranged to cooperate with the first set of engagement means in order to hold the four wall sections together in a rectangle wherein, to assemble the four wall sections, the first pair of opposed wall sections are set slightly inward of the engagement means which extend from the second pair of opposed wall sections, with the first set of opposed wall sections being arranged to engage the second set of opposed wall sections by being pushed outwards so that the first and second sets of engagement means engage each other. This arrangement may be advantageous where a container has end wall sections which are different to the side wall sections, for example the end wall sections may have handholds therein. This also permits the container to be a rectangular shape other than a square.

Preferably, the base section and wall sections are arranged such that insertion of the base section through a mouth of the container, defined by the four wall sections, to a lower position where it forms the base of the expanded foam layer of the container, locks the wall sections into position by preventing their lower edges from moving inwards. This permits the base section to lock the walls in place preventing the wall sections coming apart should the container receive any external knocks during transportation or handling.

Preferably, the container further comprises a lid section, formed of expanded foam, wherein the upper edge of the wall sections define a mouth of the container and are profiled to form a step around an inner edge of the mouth, wherein the lid is dimensioned to sit within the mouth on the step and to lock the wall sections in place by preventing them from moving inwards. In this manner, the base section and lid section lock both the top and bottom edges of the wall sections in place.

Preferably, the lid sits flush within the top edges of the wall sections and has a locking mechanism which engages with slots on the inner surface of at least some wall sections. In this manner, a lid can be provided which is shielded by the walls, is flush to enable a number of containers to be stacked together and which can close the container without requiring the lid to be taped on the container, which is advantageous for it will likely increase the life expectancy of the container in comparison to a container which is taped closed every time it is used.

Preferably, the lid section is a lid in accordance with the fourth aspect of the present invention.

The container may further comprise a film wrap dimensioned to fit around the four walls of the container, wherein the container is arranged such that the film wrap can be placed around three assembled walls prior to the fourth wall being put in place which will act to tension the film wrap. This provides a convenient way for graphics to be applied to the container, which may be customised for a particular customer or permit for a customer to subsequently apply their own graphics to the container. The film wrap also assists in maintaining the integrity of the container should the expanded foam panels be damaged by inappropriate handling. It also permits any graphics applied to the container to be easily changed by substituting the film wrap with a different film wrap with alternative graphics.

In a particular advantageous embodiment, the container comprises a cool pack arrangement as according to the first, second and/or third aspects of the present invention.

In a particular advantageous embodiment, the container comprises an insulation panel assembly according to the fifth aspect of the present invention.

BRIEF DESCRIPTION OF THE DRAWINGS

The invention will now be described by way of example only, with reference to the accompanying drawings, of which.

DETAILED DESCRIPTION OF THE INVENTION

Figure 1:
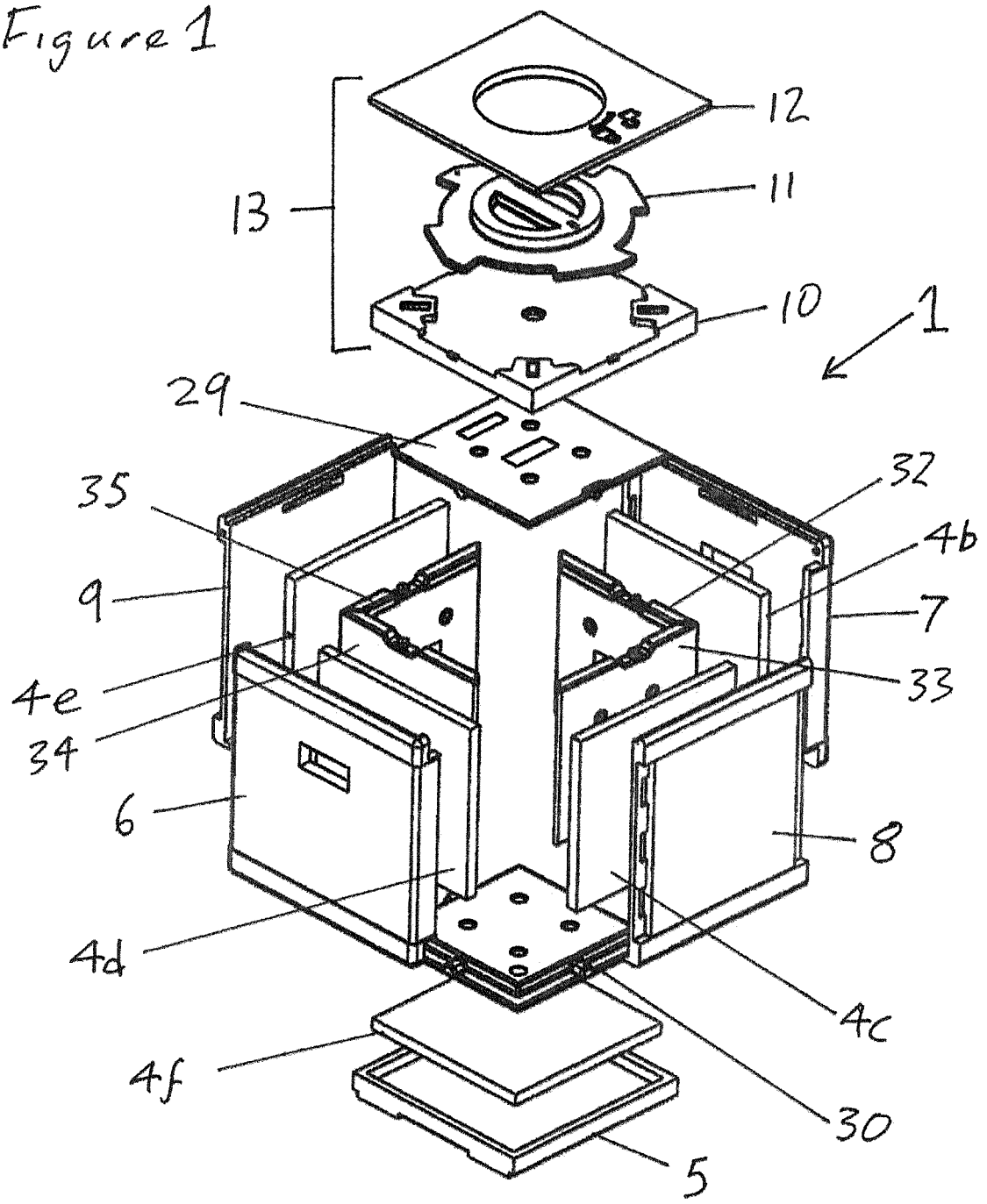
FIG. 1 is a perspective exploded view of a thermally insulated shipping container with a cool pack and lid arrangement in accordance with the present invention.
Figure 2:
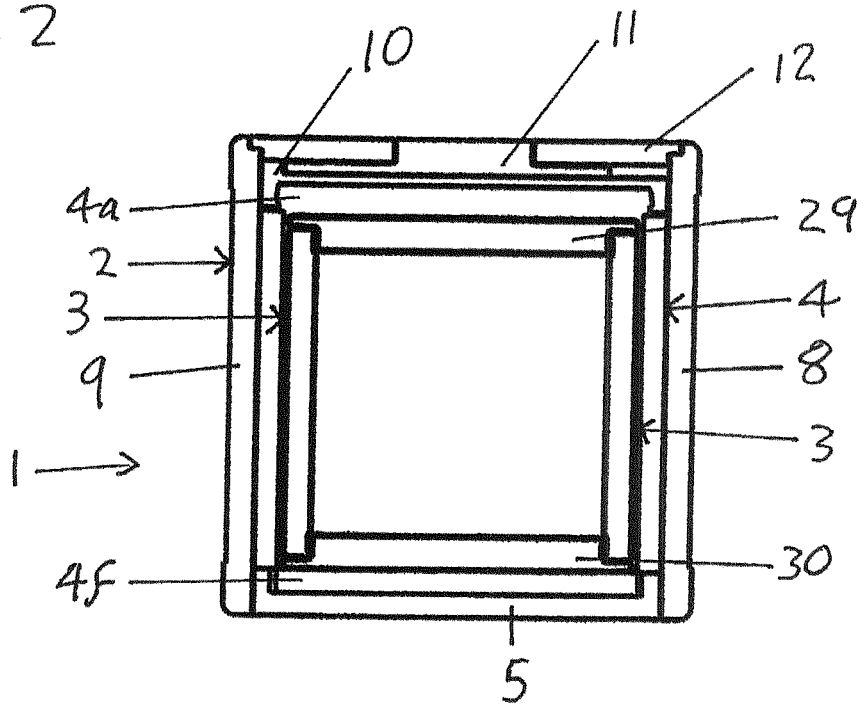
FIG. 2 is a cutaway side elevation of the assembled container of FIG. 1.
Figure 3:
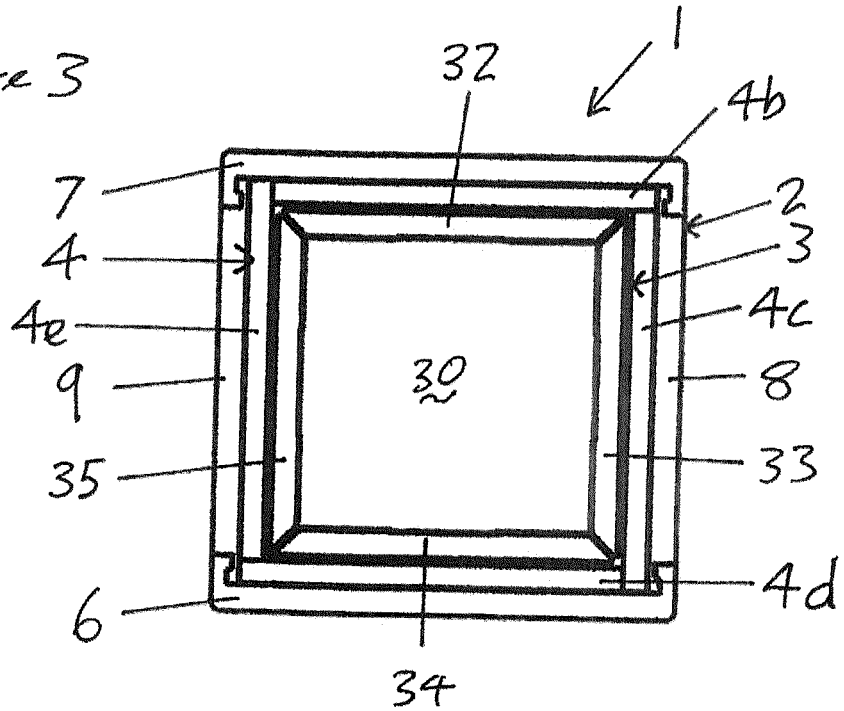
FIG. 3 is a top view of the container of FIGS. 1 and 2 with the lid removed.

Referring to FIG. 1, a thermally insulated shipping container 1 comprises a number of components which, as most clearly seen from the partially cutaway side elevation of FIG. 2 and the plan view of FIG. 3 (with the lid 13 removed) comprises three layers, indicated generally as a thermally insulating outer casing 2, a cool pack layer 3 comprising a cool pack arrangement in accordance with the present invention and a vacuum insulation panel layer 4 located between the two.

Figure 4:
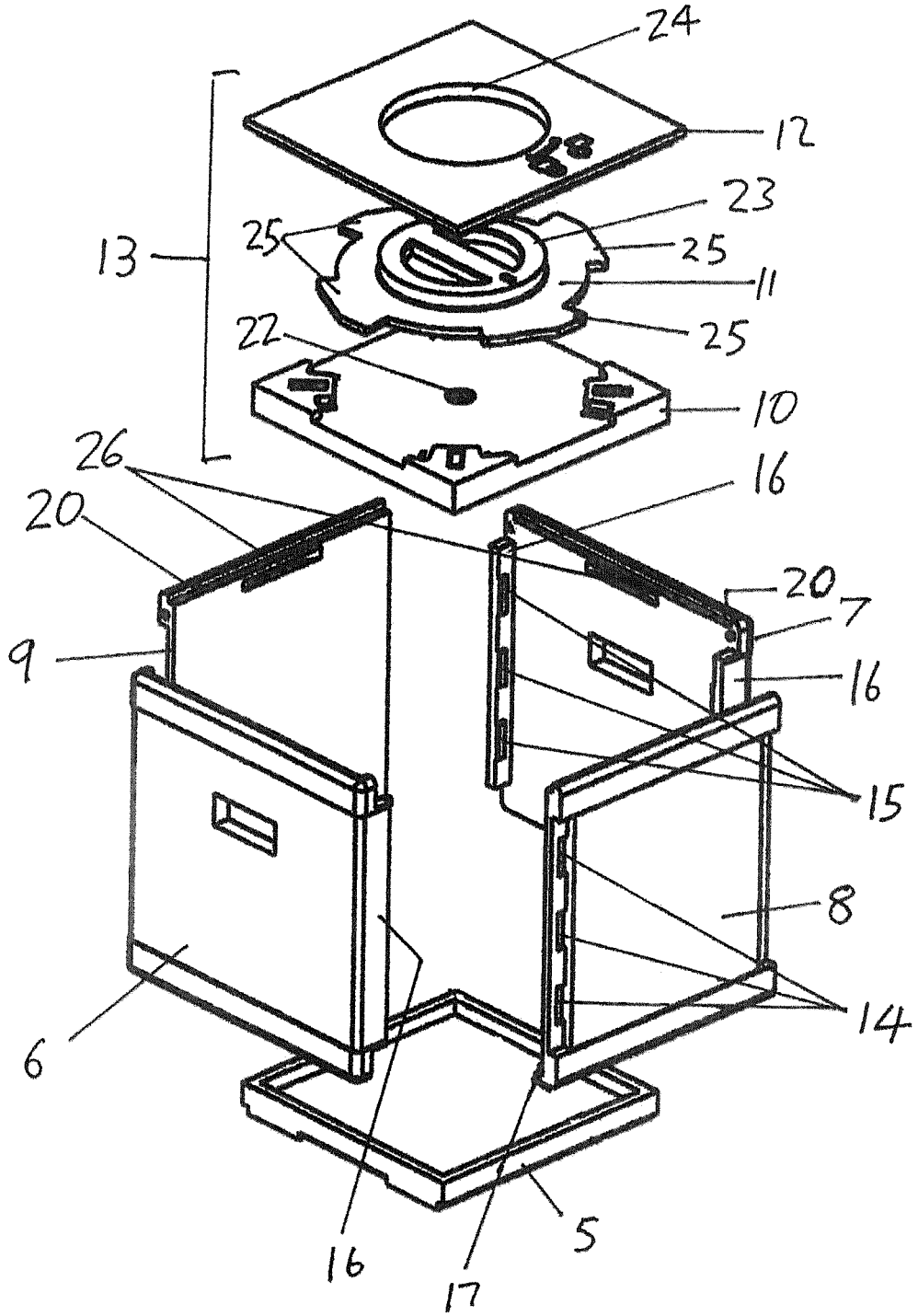
FIG. 4 is an exploded view of the components of the outer casing of the container of FIG. 1.
Figure 5:
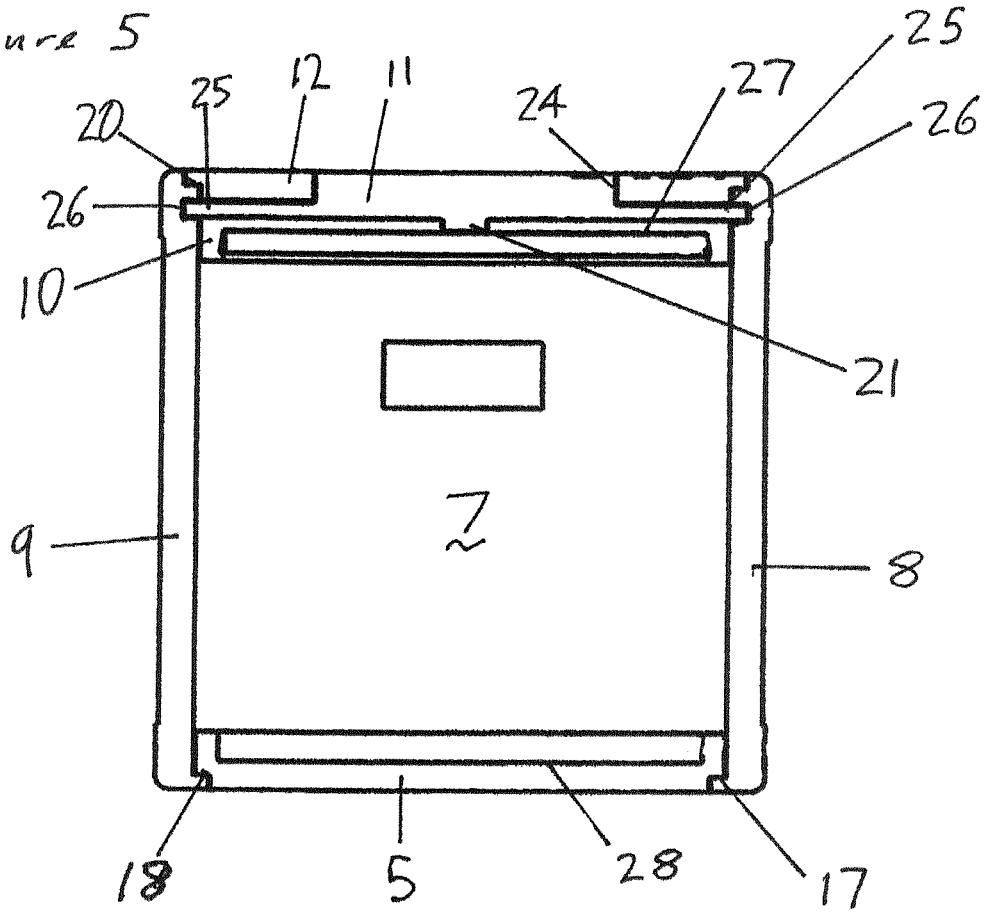
FIG. 5 is a cutaway side elevation of the components of FIG. 4 assembled.
Figure 6:
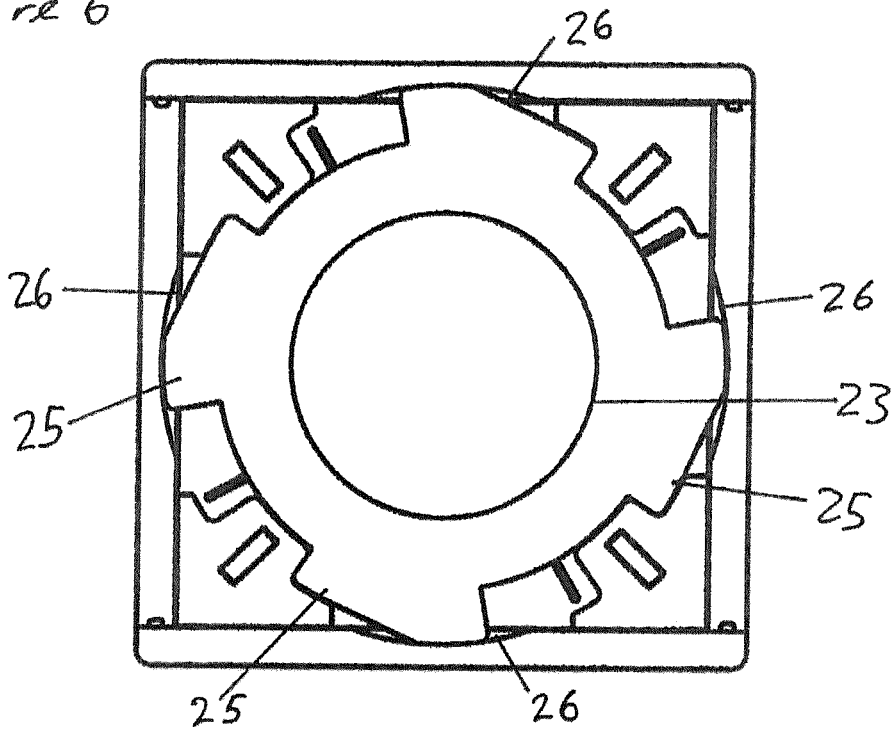
FIG. 6 is a plan view of the components of the lid portion of the casing of FIGS. 4 and 5 with a top cover portion removed.

The components 5 to 12 of the thermally insulating outer casing 2 are disclosed and described in greater detail in and with reference to FIGS. 4 to 6 and the cool packs 29 to 35 forming the cool pack layer 3 are disclosed and described in greater detail in and with reference to FIGS. 7 to 16. The vacuum insulation panels forming the vacuum insulation panel layer 4, are located as shown in FIGS. 1 to 3 and comprise six panels 4*a* to 4*f*, providing additional insulation between the respective cool packs 4*a* to 4*f* and the outer insulation casing 3.

The four insulation panels 4*b* to 4*e* are side wall insulation panels and, although not shown in FIGS. 1 to 3, are assembled into insulation panel assembly as shown in and described with reference to FIGS. 17 to 25.

Referring now to FIG. 4, the thermally insulating outer casing 2, shown in exploded view, comprises eight components each formed from expanded polypropylene (EPP) foam. The eight components comprise a base 5, a first pair of identical opposed walls 6 and 7, a second pair of identical opposed walls 8 and 9, a lid, indicated generally as 13 having an inner portion 10, a locking portion 11 and an outer portion 12.

Each of the second pairs of walls 8 and 9 have a plurality of sockets 14 moulded into both side edges of their outer faces. These engage with plugs 15 which protrude from extension portions 16 on the inward facing side edges of each of the first pairs of walls 6 and 7, only one set of which can be seen in FIG. 4.

To assemble the outer casing 2, the second pair of walls 8 and 9 are positioned between respective pairs of extension portions 16 on each of the walls 6 and 7 and moved outwards until the plugs 15 on the walls 6 and 7 engage in the sockets 14 on the walls 8 and 9. Base 5 is then inserted and pushed down between the assembled walls 6 to 9 to the position shown in FIG. 5, where it is retained in place by lips 17 and 18. The base locks the bottoms of the walls 6 to 9 in place by preventing walls 8 and 9 moving inwardly. The lid 13, when assembled sits between the walls 6 to 9, being retained in place by a step 20 running along the top edges of the walls 6 to 9. This similarly locks the tops of the walls 6 to 9 in place.

The lid 13, shown in FIG. 4, has a locking portion 11 sandwiched between the inner portion 10 of the lid 13 and the outer portion 12 of the lid 13 which inner and outer portions 10 and 12 are fixed together to form the lid 13. The locking portion 11 is rotatably retained in place by a downwardly protruding pin 21, seen in FIG. 5, engaging in the aperture 22 in the inner portion of the lid 10 and with the upper protruding portion 23 of the locking portion 11 of the lid engaging in the aperture 24 in the outer portion of the lid 12.

The locking portion 11 has four protrusions 25, which when the locking portion 11 of the lid is rotated to a "locked" position extend beyond the four edges of the lid, engaging with respective slots 26 in the top of the walls 6 to 9, to lock the lid in place, as shown in FIGS. 5 and 6.

As can be seen most clearly from FIG. 5, both the inner portion 10 of the lid 13 and the base 5 have recesses 27 and 28. The vacuum insulation panels 4*a* and 4*f*, forming the top and bottom of the vacuum insulation panel layer 4 of FIGS. 1 to 3, are accommodated in these recesses 27, 28, as shown in FIGS. 1 and 2. The remaining vacuum insulation panels 4*b* to 4*e*, of the outer vacuum, insulation panels 4 are then arranged as an assembly against the inner faces of the four walls 6 to 9 of the outer casing 2.

The thermally insulating outer casing 2, being formed from individually moulded walls 6 to 9 defines an inner space between the walls 6 to 9, which space has parallel vertical sides, which would not normally be possible if the four walls 6 to 9 and base 5 had been moulded as a single piece (for it would normally necessary to have tapered inner walls to permit the casing to be released from a mould tool). The advantage of having parallel inner walls is that they can correctly accommodate both standard rectangular or square vacuum insulation panels 4*b* to 4*e* of the vacuum insulation panel assembly discussed below with reference to FIGS. 7 to 16, keeping both the vacuum panels and cool packs tightly confined in order to minimise convection between adjacent panels or cool packs and to retain a correctly packed product in place.

If desired a stretch film wrap may be provided around three of the assembled walls and 6 to 9 of the outer casing 2, prior to the fourth wall being locked in place and tensioning the film wrap. This may not only assist in keeping the walls of the outer container locked together, especially in the event of the container being dropped or otherwise suffering a major impact, but the wrap may also be preprinted and thus provides an easy way of customising graphics on the container 1 for a particular customer, or enables the customer to easily apply their own graphics.

Once the outer casing 2 has been assembled, as shown in FIG. 5, and the vacuum insulation panels 4*b* to 4*e* inserted, the cool packs (once cooled) of FIGS. 7 to 16 may be inserted therein to form the cool pack layer 3.

Figure 7:
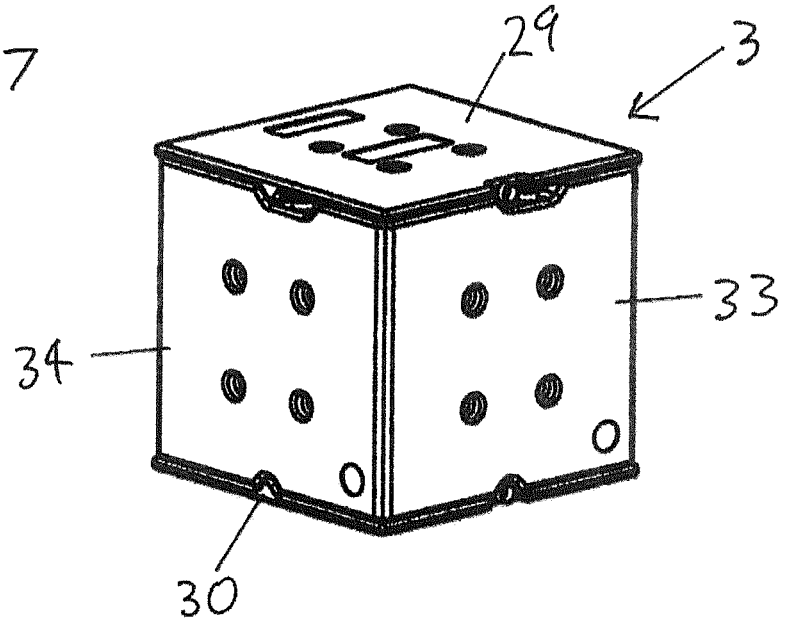
FIG. 7 is a perspective view of the cool pack arrangement of the container of FIG. 1.
Figure 8:
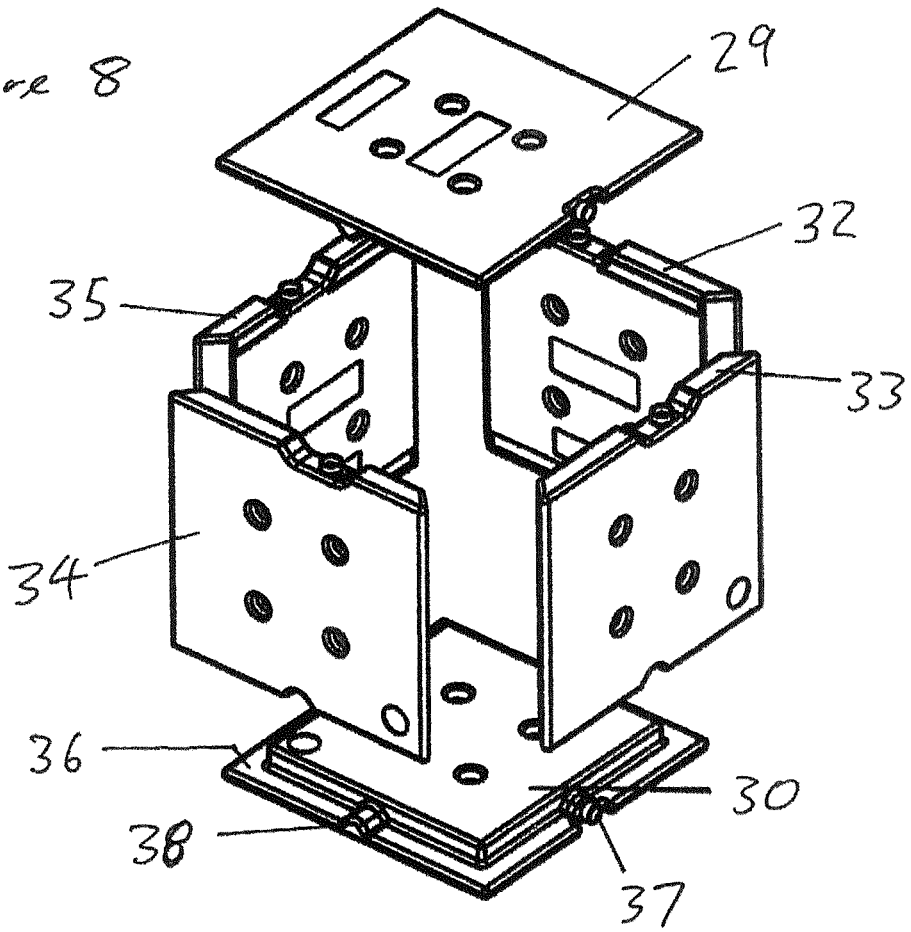
FIG. 8 is a perspective exploded view of the cool packs of FIG. 7.

The cool pack layer is shown in FIG. 7 as it would be arranged in the container 1 of FIG. 1. As shown in FIG. 8, the cool pack layer 3 comprises only two components types, comprising identical top and bottom cool packs 29 and 30, shown in greater detail in FIGS. 9 and 10, and four identical side wall cool packs 32 to 35, shown in greater detail in FIGS. 11 and 12. Each of the cool packs may be formed by standard moulding technique and filled with a water-based material or other phase change material such as paraffin wax, which can subsequently be cooled.

The top and bottom cool packs 29 and 30 will now be described in more detail with reference to FIGS. 9 and 10. In the following discussion the illustrated cool pack is taken to be the bottom cool pack 30, but the same features are found on the identical top cool pack 29 of FIG. 8.

Figure 9:
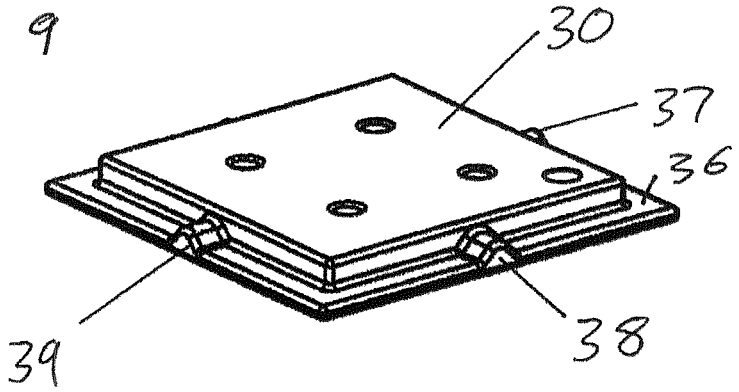
FIG. 9 is a perspective view of a top or bottom cool pack of FIG. 8.
Figure 10:
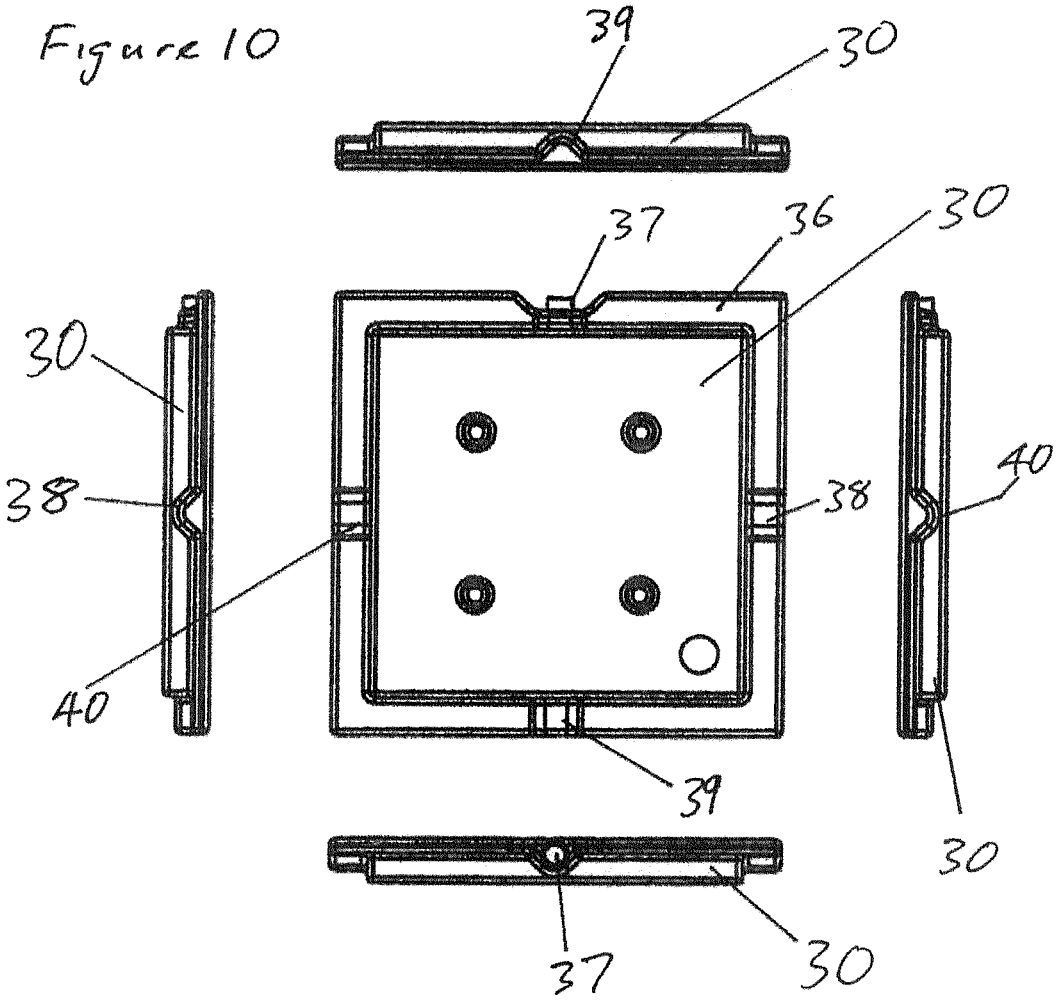
FIG. 10 is a plan view, together with respective side elevations, of the cool pack of FIG. 9.

The bottom cool pack 30 of FIG. 9 is provided with a step 36 around all four edges, with a fill point cap 37 on one of the edges. Because the cool pack 30 is relatively thin in the region below the step 36, the fill point cap 37 extends above the level of the tread portion of the step 36 and partly protrudes out of the riser portion of the step above the tread portion. In corresponding positions on each of the other three sides of the cool pack 30 there are provided blanking protrusions 38 to 40, the purpose of which is described below.

Figure 11:
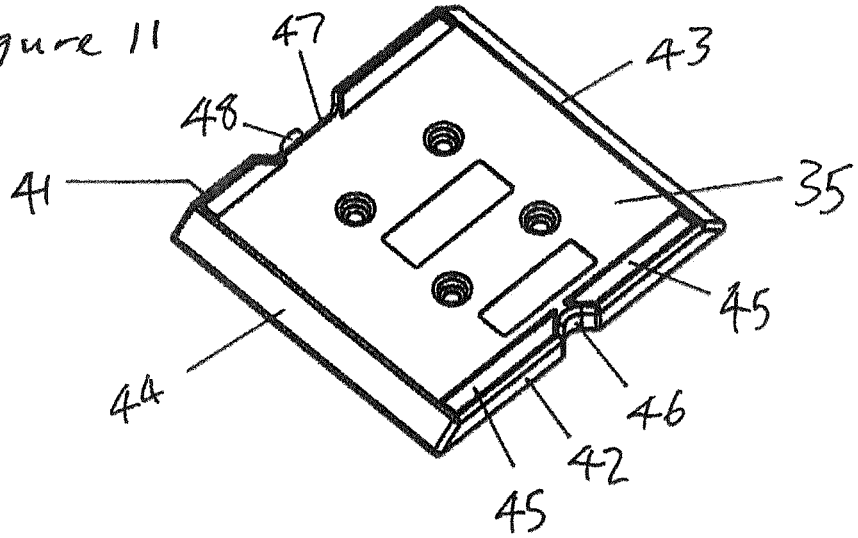
FIG. 11 is a perspective view of a side wall cool pack of FIG. 7.
Figure 12:
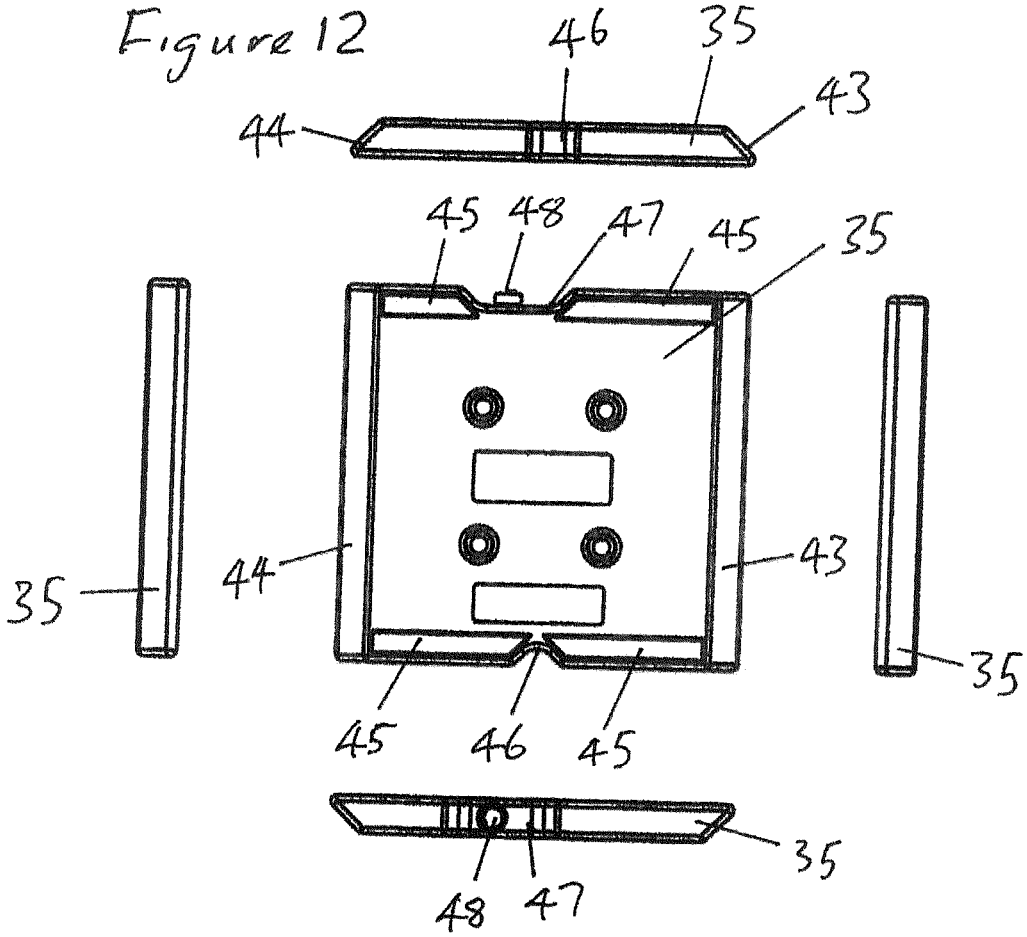
FIG. 12 is plan view, together with respective side elevations, of the side wall cool pack of FIG. 11.
Figure 13:
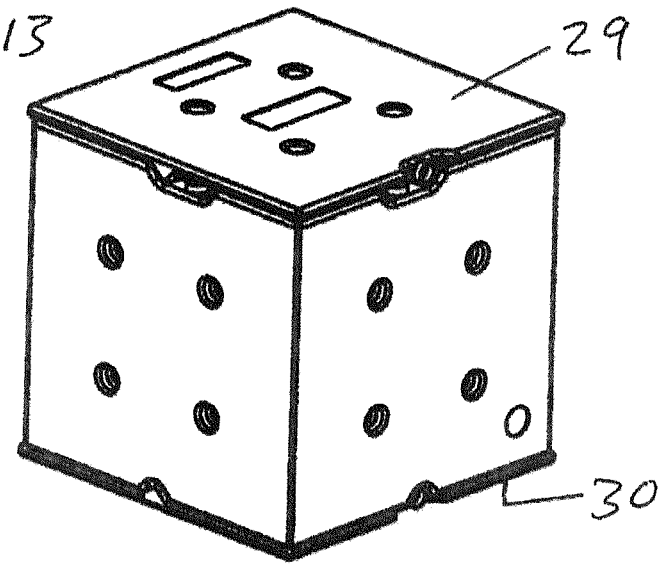
FIG. 13 is a perspective view of an alternative set of cool packs for the container of FIG. 1.
Figure 14:
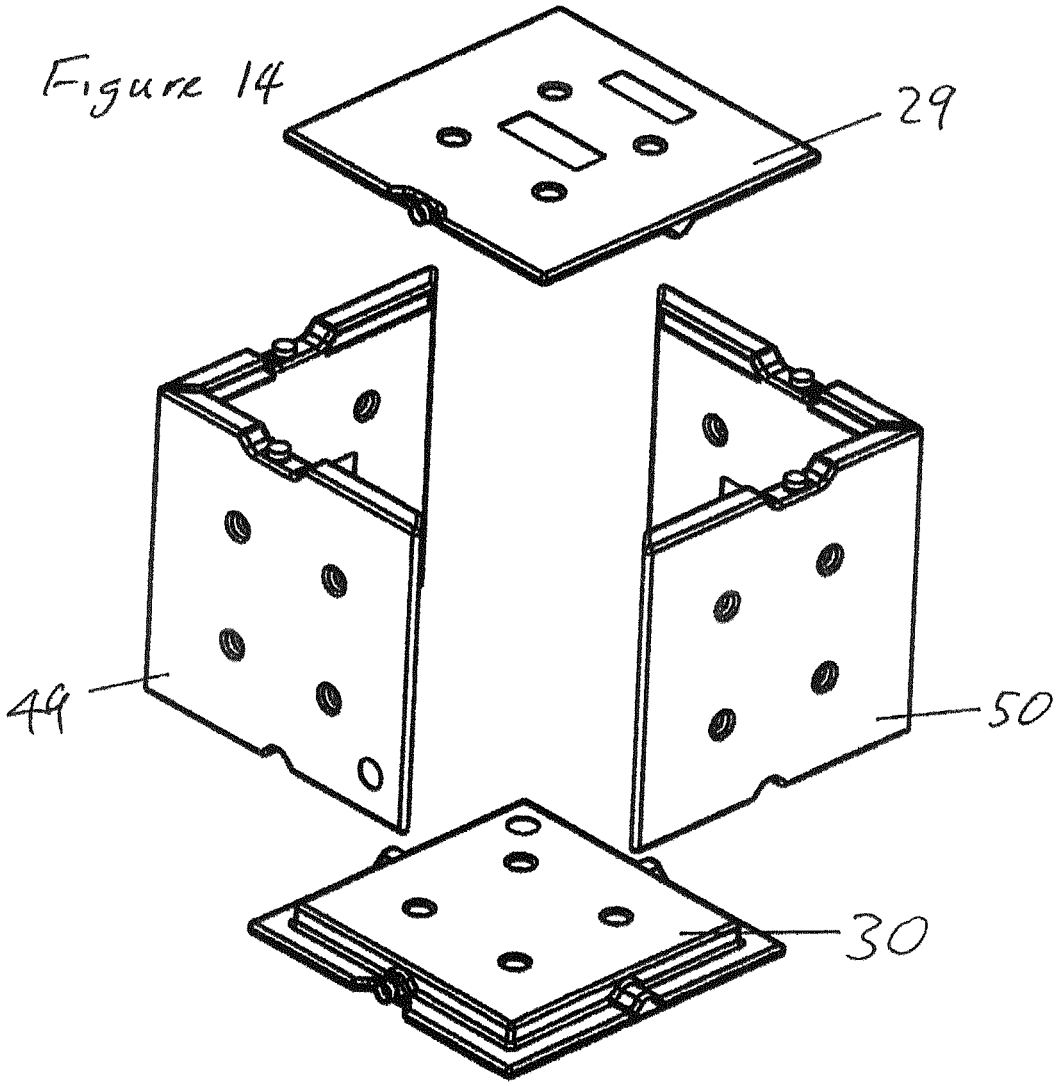
FIG. 14 is an exploded perspective view of the cool packs of FIG. 13.
Figure 15:
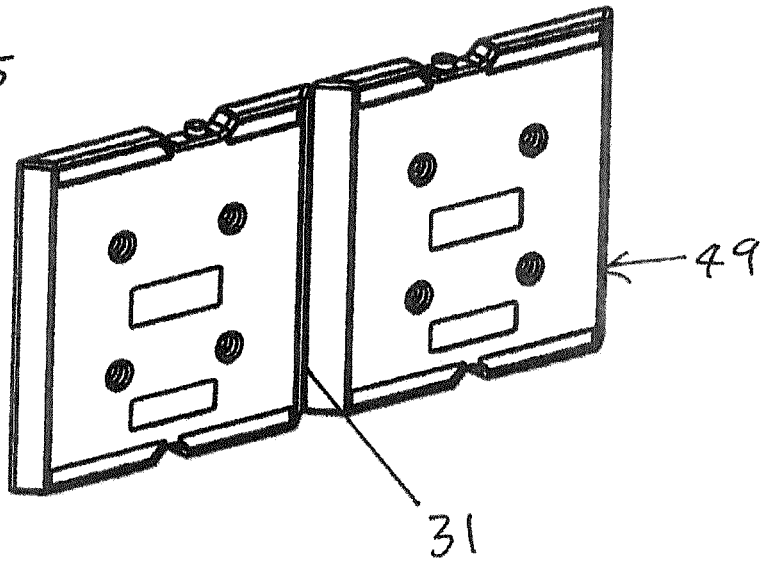
FIG. 15 is a perspective view of a side wall cool pack of FIG. 13.
Figure 16:
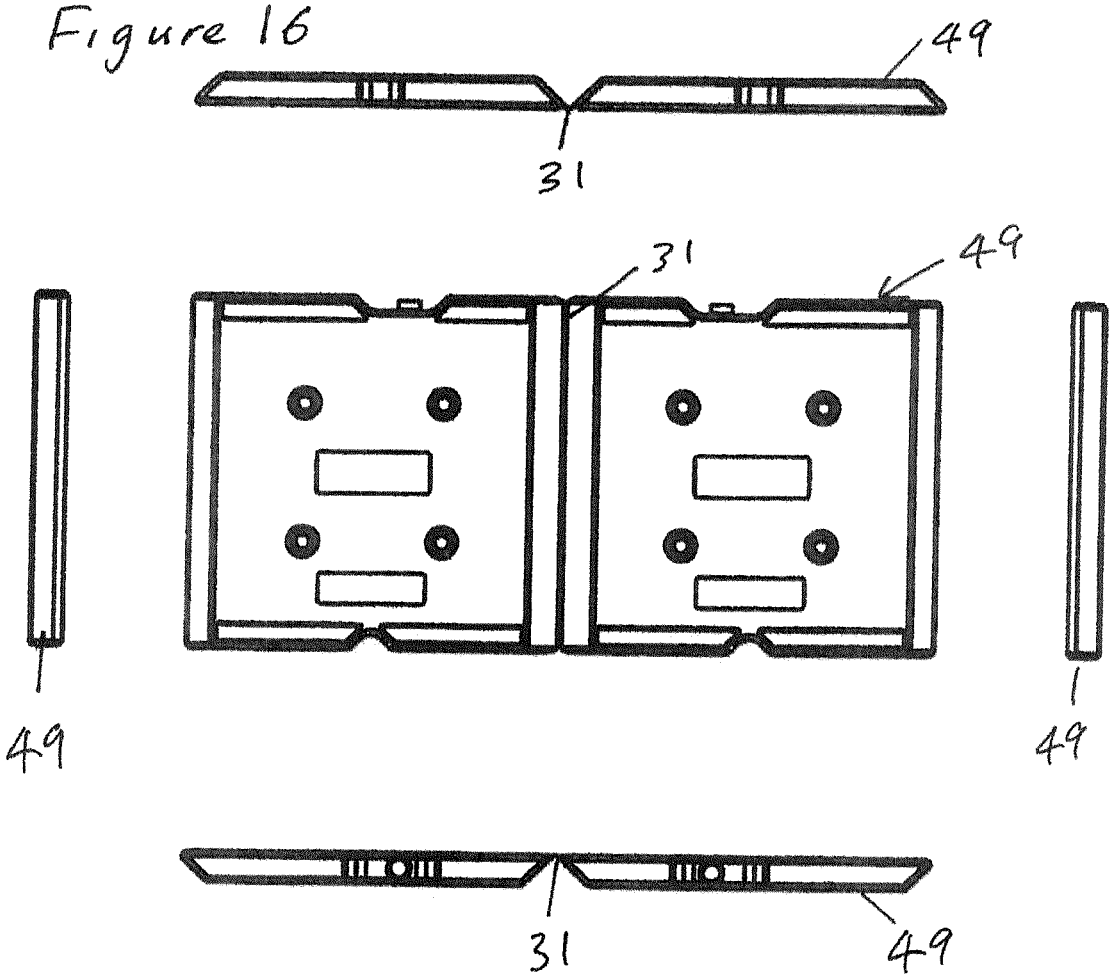
FIG. 16 is plan view, together with respective side elevations, of the side wall cool pack of FIG. 15.

Referring now to FIGS. 11 and 12, there is illustrated one side wall cool pack 35, identical to each of the other side wall cool packs 32 to 34. This has flat top and bottom edges 41, 42 perpendicular to the front and rear faces of the cool pack 35 and side edges 43, 44 chamfered at 45° to abut adjacent chamfered side edges 44, 43 of adjacent cool packs, when assembled as shown in FIG. 7 inside the container 1 of FIG. 1.

Referring again to FIGS. 11 and 12, each side wall cool pack 32 to 35 has vertical notches 45 formed along the top and bottom edges of its inner face and a small recess 46 in the top or bottom edge 42 and a larger recess 47 formed in the opposite edge 41, in which the fill point cap 48 is accommodated, off-set to one side of the layer recess 47. The notches 45 assist when lifting the side wall cool packs 32 to 34 out of the container. The fill point cap 48 being off-set leaves the recess 47 clear in a midpoint, opposite to the smaller recess 46 in the opposite edge. The side wall cool packs 32 to 35 are readily distinguishable from the top and bottom cool packs 29 and 30 by their chamfered side edges 43, 44 and absence of a step 36. Therefore, when inserting a cool pack layer 3 within the assembled outer casing 2 it is to identify the top and bottom cool packs 29, 30 from the side wall cool packs 32 to 35 and first place one into the base of the outer casing 2 of the container 1 of FIG. 1.

Each side wall cool pack 32 to 35, in use, may be located in any of the four side wall positions of FIG. 7 and may be mounted with either of its flat edges downwards, as each side wall cool pack 32 to 35, either way up, will accommodate the fill point cap 37 of the bottom cool pack 30. This will either be accommodated in a smaller recess 46 or a larger recess 47 of the respective side wall cool pack 32 to 35.

The riser portion of the step 36 on the bottom cool pack 30, abutting the horizontal flat bottom edge of the side wall cool packs 32 to 35, resists convection of air by providing a double step for any convection currents to negotiate. This double step feature is also present along the top edges of the side wall cool packs 32 to 35, where they engage the step 36 of the top cool pack 29 of FIG. 5.

When the cool packs 29 to 34 are assembled, as shown in FIG. 7, the protrusions 38 to 40 on the top and bottom cool packs 29 and 30 fit and fill the notches 46 or 47 of the side wall cool packs 32 to 35, (necessary to accommodate fill point cap 37) and restrict the convection through these notches to further prevent convection.

The step 36 on the bottom cool pack 30, being square, as opposed to chamfered, additionally assists in assembly of the side wall cool packs 32 to 35, for the step 36 acts to stop the first side wall cool pack inserted falling inwards before adjacent side wall cool pack 32 to 35 are inserted.

Referring now to FIGS. 13 to 16, there is shown a slightly modified set of cool packs 49, 50 for use, as the wall portion of the cool pack layer 3 of the container 1 of FIG. 1. The top and bottom cool packs 29 and 30 are identical to those disclosed in FIGS. 7 to 9, but in this embodiment instead of there being four side wall cool packs there are instead only the two identical "double" side wall cool packs 49 and 50. Each of the two side wall cool packs 49 and 50 effectively comprises two side wall cool packs as previously described with reference to FIGS. 7 to 8 and 11 to 12, but which are joined by a living hinge 31. These can be formed by blow moulding in a conventional manner but with the sides of the moulds being brought together to form a living hinge 31, or the living hinge 31 can be formed by a separate subsequent step in the manufacturing process.

Figure 17:
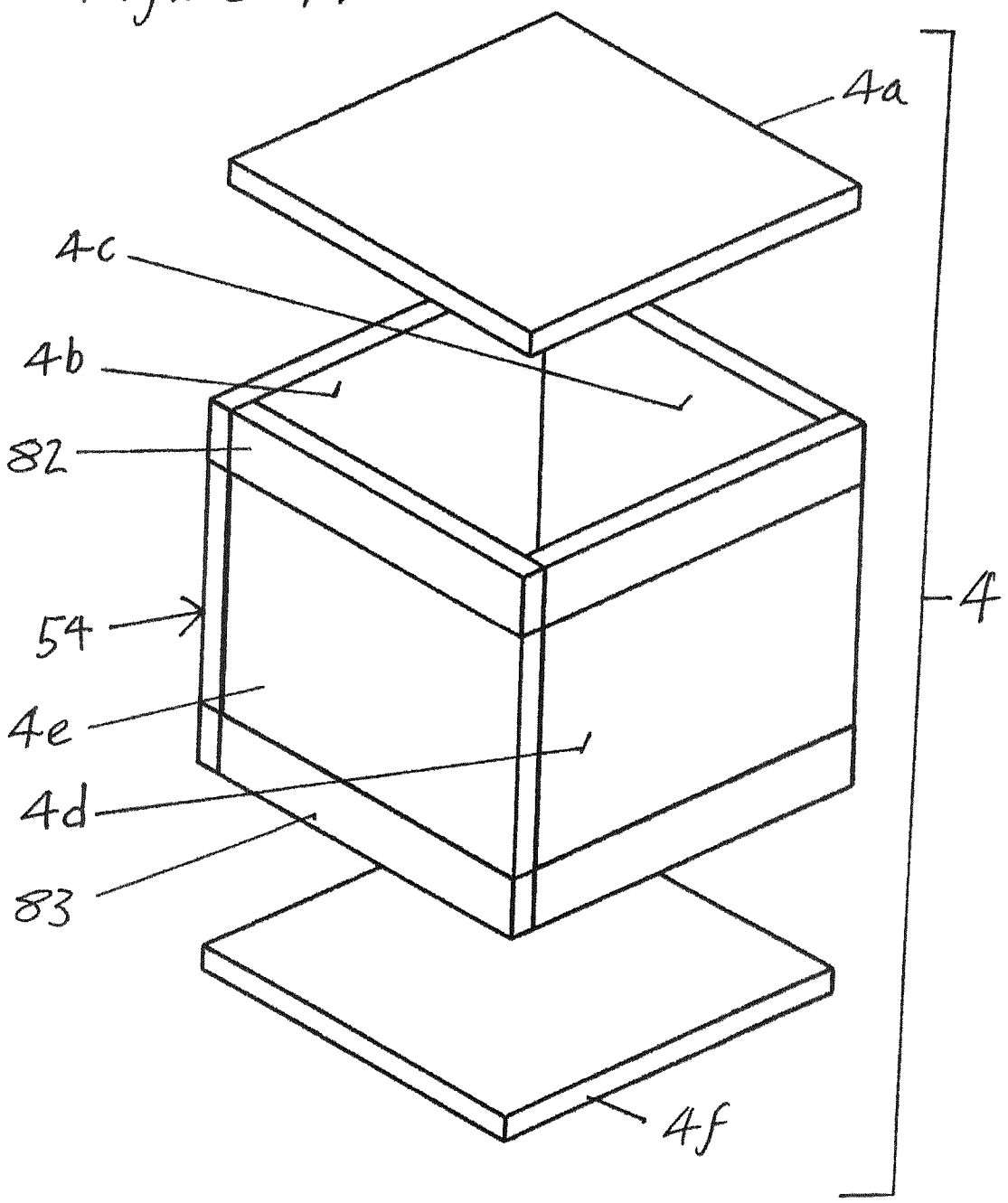
FIG. 17 is an expanded perspective view of a top insulation panel, side wall insulation panel assembly and bottom insulation panel for the container of FIG. 1.

Referring now to FIG. 17, this illustrates the components of the vacuum insulation panel layer 4.

The vacuum insulation panel layer 4 comprises a top vacuum insulation panel 4*a*, a bottom vacuum insulation panel 41 and a vacuum insulation panel assembly 54.

Figure 18:
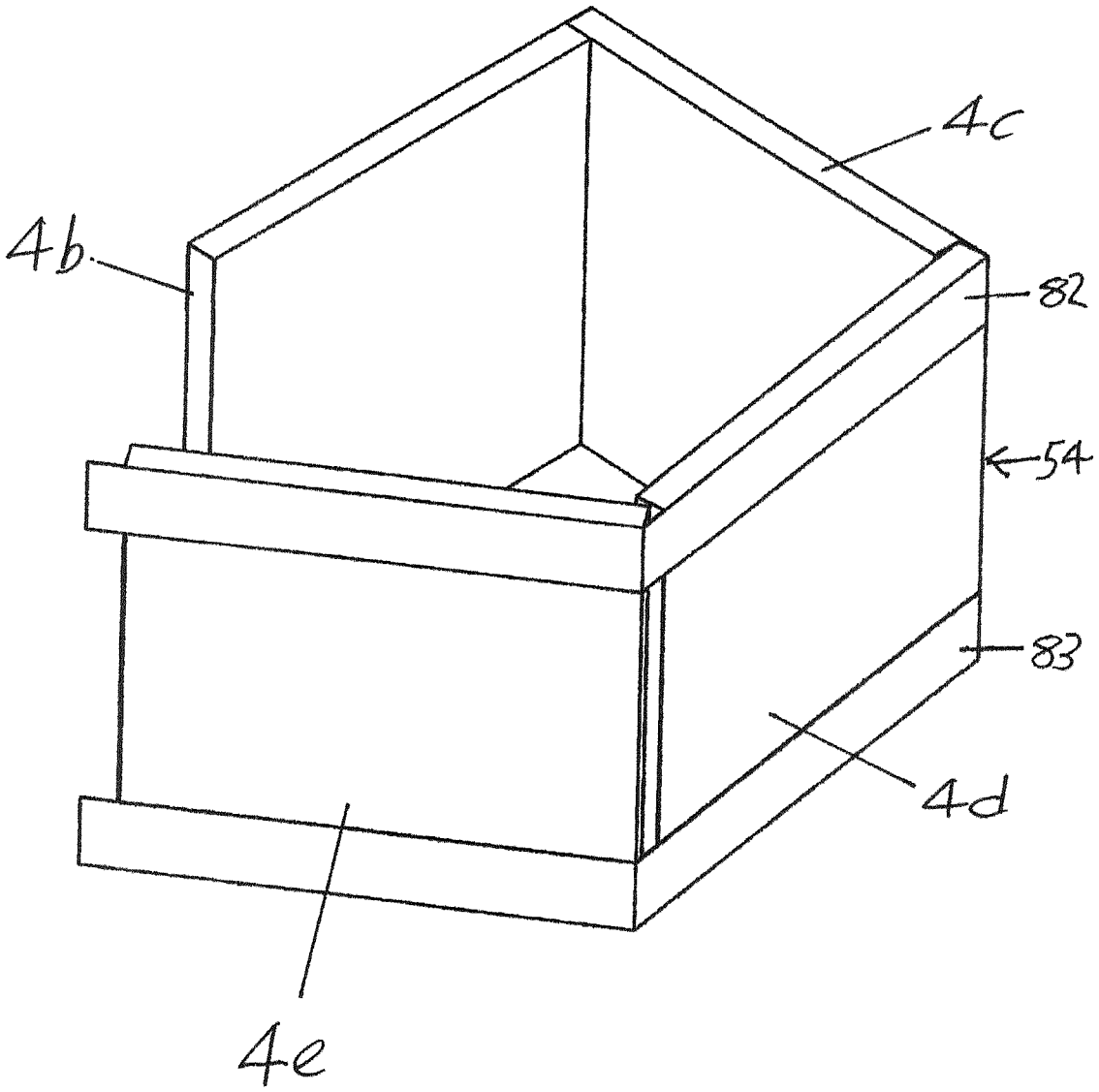
FIG. 18 shows the side wall insulation panel assembly of FIG. 17 prior to insertion into the container of FIG. 1.
Figure 19:
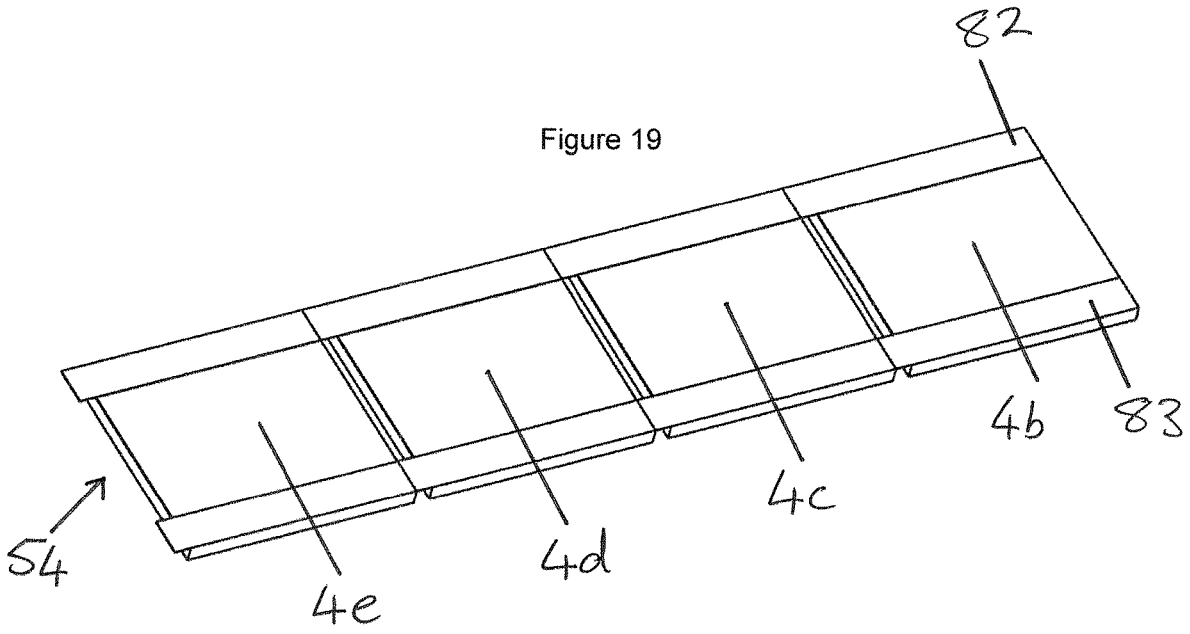
FIG. 19 is a perspective view of the side wall insulation panel assembly of FIG. 18 laid out as a linear array.
Figure 20:
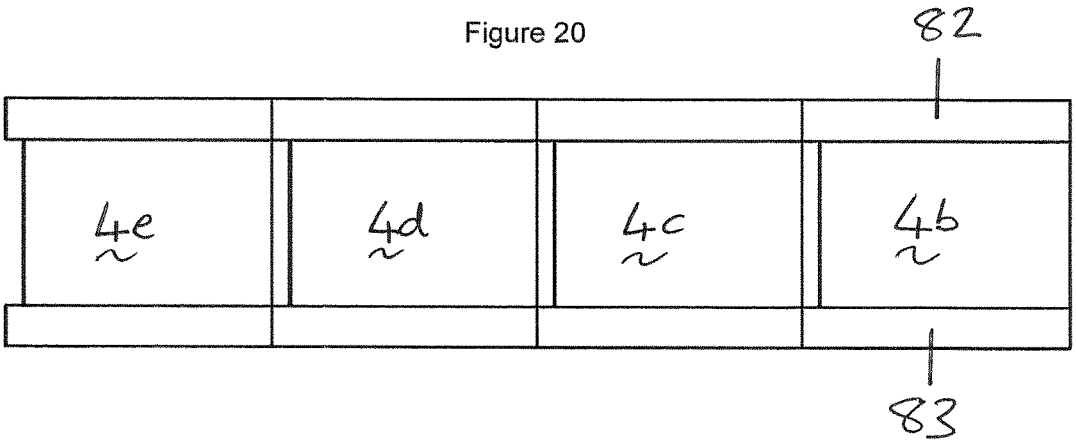
FIG. 20 is a plan view of the insulation panel assembly of FIG. 19.
Figure 21:
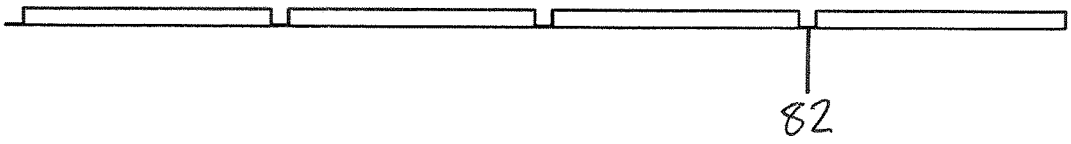
FIG. 21 is a side elevation of the insulation panel assembly of FIG. 20.

As will be described below with reference to FIGS. 23 to 25, with this assembly 54, the side wall vacuum insulation panels 4*b* to 4*e* may be tightly bound together when in use, as illustrated in FIGS. 17 and 18, without the need to tape them together. This also provides a vacuum insulation panel assembly 54 that is capable of being easily and quickly inserted into the thermally insulating outer layer 2, once this has been assembled.

Figure 22:
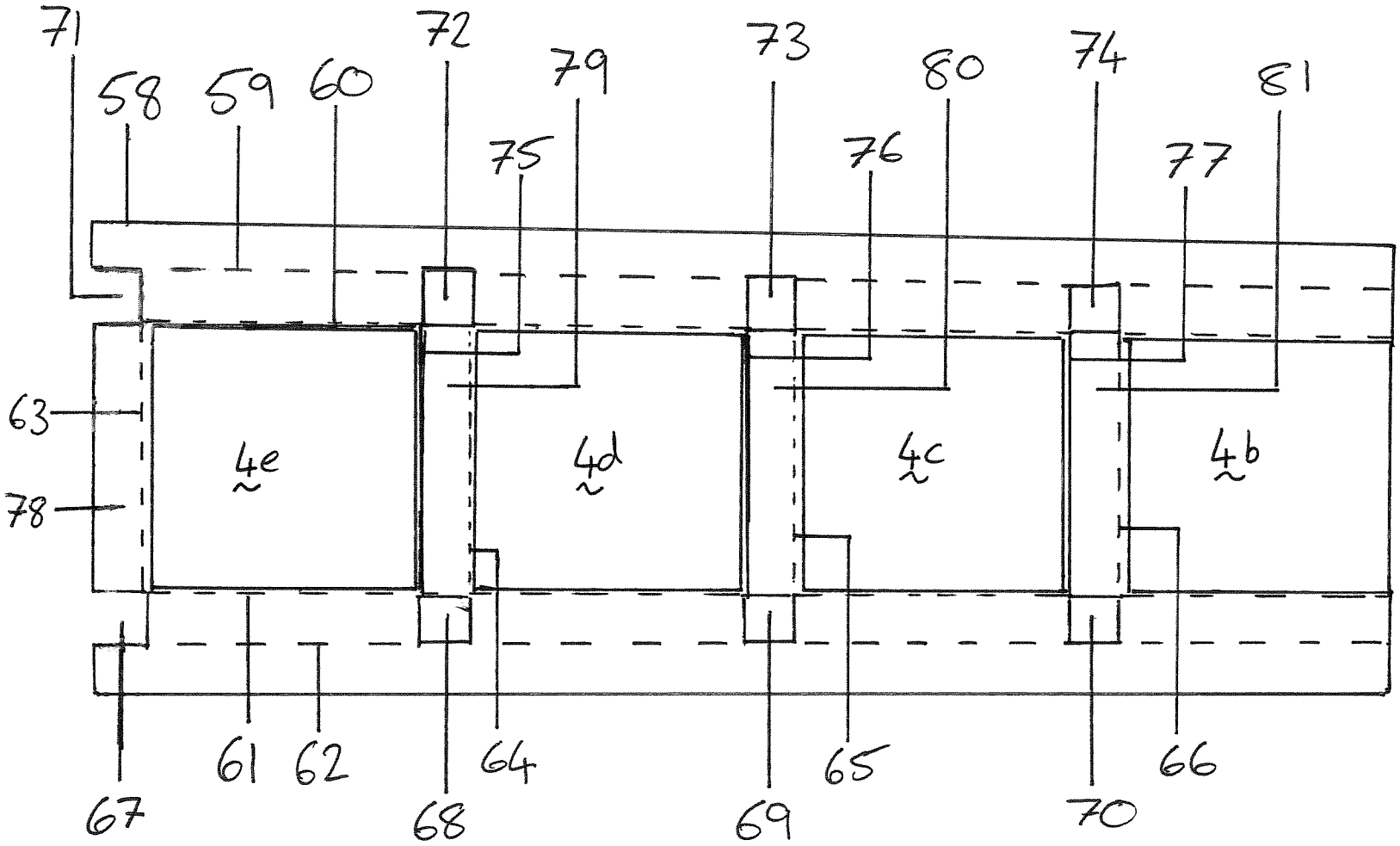
FIG. 22 illustrates the components of the side wall insulation panel assembly of FIGS. 17 to 21, prior to assembly.

The components of the vacuum insulation panel assembly 54 are shown in FIG. 22, prior to assembly. These comprise the four side wall insulation panels 4*b* to 4*e* and a thin PVC sheet 58. The PVC sheet 58 is shown laid flat with the four side wall vacuum insulation panels 4*b* to 4*e* laid thereon with their outer faces uppermost. The PVC sheet is formed with four creases 59 to 62 extending parallel to the top and bottom edges of the sheet 58 and four creases 63 to 66 extending perpendicular to the top and bottom edges of the sheet 58. Each crease is formed so that it acts to fold the sheet to either side of the crease, out of the page as shown in FIG. 23.

The sheet 58 has four cut out sections (although they could be formed other than by being cut) 67 to 70, formed between the parallel creases 61 and 62 and four corresponding cut out sections 71 to 74 formed between parallel creases 59 and 60. In addition, cuts 75 to 77 extend between respective pairs of cut out sections 68, 72; 69, 73; and 70, 74 to form four flaps 78 to 81 defined by the respective cuts 75 to 77 or edge of the sheet 58 and respective perpendicular creases 63 to 66. The width of each flap 78 to 81 is the same as the depth of the side wall vacuum insulation panels 4*b* to 4*e*, with the perpendicular creases 63 to 66 urging the flaps 78 to 81 vertically, out of the page as shown in FIG. 22, so that they lie adjacent to a side edge of a respective vacuum insulation panel 4*b* to 4*e*.

The two parallel creases 59 and 60 are also separated by a distance equal to the width of the vacuum insulation panels 4*b* to 4*e*, with the two creases together urging the top edge portion of sheet 58 to fold through 180° and wrap over the top edge of the vacuum insulation panels, sandwiching the vacuum insulation panels therebetween. Creases 61, 62 likewise cause the bottom edge of the sheet 58 to wrap over the bottom edges of the vacuum insulation panels 4*b* to 4*e*. Thus, the top and bottom edges of the sheet 58, as shown in FIGS. 17 to 20, thus now respectively form a top strip 82 and a bottom strip 83, which strips 82, 83 both extend across the outer faces of vacuum insulation panels 4*b* to 4*e*. The vacuum insulation panels can optionally then be adhered in place.

Figure 23:
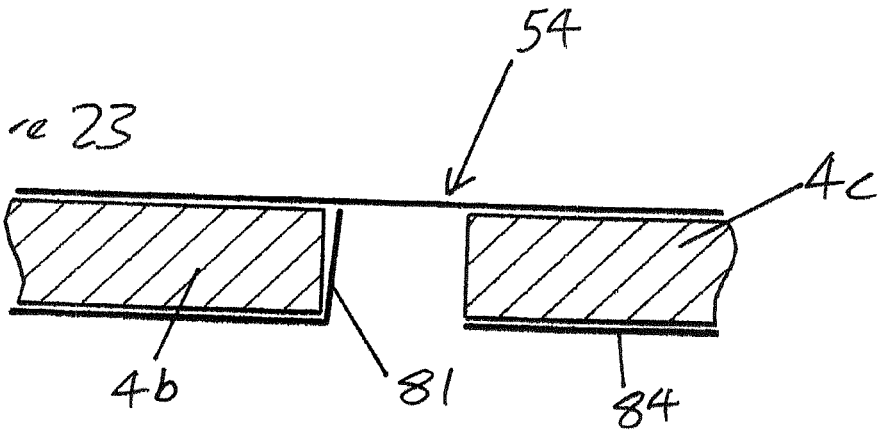
FIGS. 23 to 25 are top views showing two side wall insulation panels of the side wall insulation panel assembly, of FIGS. 17 to 21, at various stages as the side wall insulation panels are folded together.

Referring now to FIG. 23, this shows an edge view of a section of the vacuum insulation panel assembly 54, showing the sheet 58 and two of the vacuum insulation panels 4*b* and 4*c*. From FIG. 23 it can be seen that in addition to forming top and bottom strips 82 and 83 (only 82 of which is shown) on the outward facing surfaces of vacuum insulation panels 4*b* to 4*e*, the sheet 58 also provides covering sections 84 for the inner faces of the vacuum insulation panels 4*b* to 4*e*. Respective flaps 78 to 81 form extension portions to the covering sections 84, which wrap around one edge only of the respective vacuum insulation panels 4*b* to 4*e*.

Figure 24:
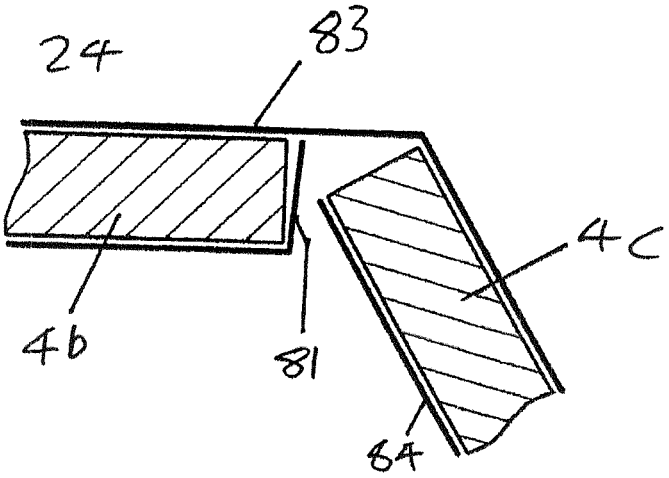
Figure 25:
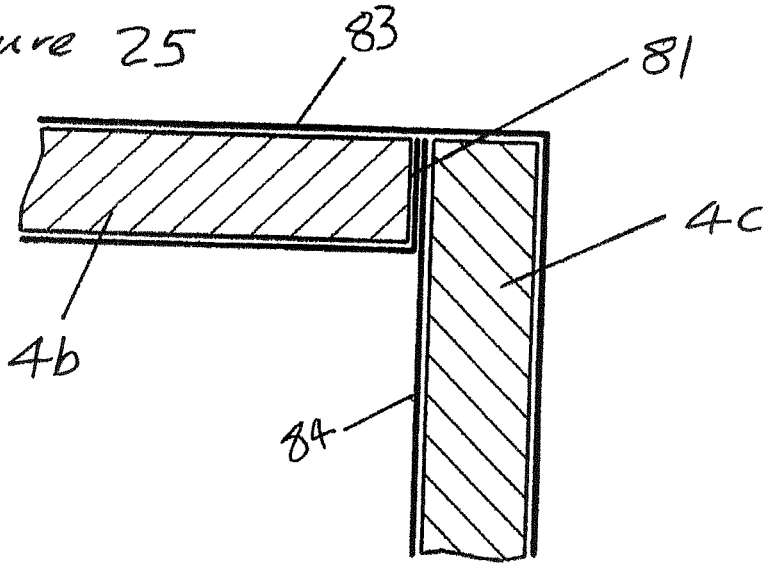

As shown in FIGS. 24 and 25, as adjacent vacuum insulation panels 4*b*, 4*c* are folded together, the flap 81 is sandwiched between a side edge of vacuum insulation panel 4*b* and the side edge of a front face of adjacent vacuum insulation panel 4*c*, with the top and bottom strips 82 and 83 urging the side edge of vacuum insulation panel 4*c* against the edge of an inner face of adjacent vacuum insulation panel 4*b* and maintaining them there, avoiding the need for the vacuum insulation panels 4*b*, 4*c* to be subsequently taped together. Once the vacuum insulation panel assembly 54 has been folded together, as shown in FIG. 17, the PVC sheet 58 then forms a lining for the inner surfaces of the side wall vacuum insulation panels 4*b* to 4*e*. These surfaces are maintained substantially flat by one side edge of the covering section 84 and extension portion, or flaps 78 to 81 forming a right angle and with the opposite edge of each covering section 84 overlapping with and being sandwiched against the respective flap 78 to 81, as shown in FIG. 23. Thus each covering section 84 effectively not only covers the inner face of each side wall vacuum insulation panel 4*b* to 4*e*, but also extends over the top and bottom edges to form top and bottom strips 82 and 83. Thus the sheet 58 covers all exposed surfaces of the vacuum insulation panels 4*b* to 4*e* when they are assembled in the thermal insulating outer casing 2 of container 1 and protects the vacuum insulation panels 4*b* to 4*e* when the cool packs are inserted in the container 1.

One embodiment of the present invention has been described by way of example only with reference to the accompanying drawings and it will be apparent that many modifications may be made which fall within the scope of the invention as defined by the appended claims.

The invention claimed is:

1. A thermally insulated container comprising:

a base;

an outer casing having a lower edge attached to the base and comprising four outer sidewalls, the outer casing having an upper edge opposite the lower edge, the outer casing having four outer corners;

a lid attached to the upper edge of the outer casing;

the base, the outer casing and the lid defining an interior; and an inner cool pack layer disposed within the interior, the inner cool pack layer consisting essentially of a top cool pack comprising a single top compartment having substantially parallel, planar front and rear major surfaces and four top edges, a bottom cool pack comprising a single bottom compartment having substantially parallel, planar front and rear major surfaces and four bottom edges, and identical first and second side wall cool packs;

each of the first and second side wall cool packs consisting essentially of two side wall compartments joined together by an integrally formed living hinge;

each of the top compartment, the bottom compartment and the side wall compartments defining an inner space containing a sealed in coolant;

each of the side wall compartments further comprising substantially parallel, planar front and rear major surfaces, a free top edge, a free bottom edge, a hinge-facing side edge adjacent the living hinge and a free side edge opposite the hinge-facing side edge, the hinge-facing side edge and the free side edge being chamfered at substantially 45 degrees; wherein the first side wall cool pack and the second side wall cool pack are arranged within the interior to form four inner sidewalls and four inner corners, two of the four inner corners being formed by the living hinges and the other two inner corners being formed from the free side edges of the first and second side wall cool packs, the thickness of the four inner sidewalls being uniform;

each of the top compartment, bottom compartment and side wall compartments further comprises a fill point cap located along an edge;

the bottom compartment further comprises a protrusion located along each of the other three bottom edges; and each side wall compartment further comprises a first recess formed in the bottom free edge for accommodating one of the protrusions and a second recess formed in the top free edge for accommodating one of the fill point caps.

2. The thermally insulated container of claim 1 further comprising:

a vacuum insulation panel layer disposed within the interior on a side of the inner cool pack layer opposite the outer casing.

3. The thermally insulated container of claim 1 wherein:

the free top edge and the free bottom edge of each side wall compartment comprises a stepped path including an angle of ninety degrees.

* * * * *